US010272352B2

(12) United States Patent
Chazen

(10) Patent No.: US 10,272,352 B2
(45) Date of Patent: Apr. 30, 2019

(54) THREE-DIMENSIONAL INTEGRATED, NUMERAL-DESIGNATED CONSTRUCTION CRAFT

(71) Applicant: Margo Sheryl Chazen, Las Vegas, NV (US)

(72) Inventor: Margo Sheryl Chazen, Las Vegas, NV (US)

( * ) Notice: Subject to any disclaimer, the term of this patent is extended or adjusted under 35 U.S.C. 154(b) by 0 days.

(21) Appl. No.: 15/232,771

(22) Filed: Aug. 9, 2016

(65) Prior Publication Data

US 2017/0036136 A1 Feb. 9, 2017

Related U.S. Application Data

(60) Provisional application No. 62/202,882, filed on Aug. 9, 2015.

(51) Int. Cl.

| | |
|---|---|
| ***A63H 33/04*** | (2006.01) |
| ***A63H 33/08*** | (2006.01) |
| ***A63H 33/14*** | (2006.01) |

(52) U.S. Cl.

CPC ..... *A63H 33/086* (2013.01); *A63H 33/04* (2013.01); *A63H 33/08* (2013.01); *A63H 33/14* (2013.01)

(58) Field of Classification Search

CPC ..... A63H 33/04; A63H 33/044; A63H 33/06; A63H 33/062; A63H 33/065; A63H 33/08; A63H 33/086; A63H 33/088; A63H 33/22; A63H 33/42

See application file for complete search history.

(56) References Cited

U.S. PATENT DOCUMENTS

| | | | | |
|---|---|---|---|---|
| 2,006,462 A | | 7/1935 | Kupper | |
| 2,618,078 A | * | 11/1952 | Weil | A63H 33/22 434/96 |
| 2,649,803 A | * | 8/1953 | Andre | A63H 33/062 446/102 |
| 3,566,529 A | * | 3/1971 | Kner et al. | A63F 9/06 446/118 |
| 3,849,912 A | * | 11/1974 | Kemnitzer | G09B 19/00 434/98 |

(Continued)

FOREIGN PATENT DOCUMENTS

GB 2425271 A * 10/2006 ..... A63H 33/08

*Primary Examiner* — Gene Kim
*Assistant Examiner* — Alyssa Hylinski
(74) *Attorney, Agent, or Firm* — Connie R. Masters

(57) ABSTRACT

A toy construction craft utilizing construction elements including modular building blocks comprises a base plate, template, one or more graphic segments, and an optional frame. The base plate is a substantially planar building surface arranged with coupling studs for being interconnected with toy building elements having complementary coupling means. The template is configured with at least one area of guidance indicia including at least numeral designation; each guidance indicia is viewed to inform the user as to the modular block(s) that should be attached to that particular stud. These designated blocks form the 3-D portion of the composition, while the graphic segment(s) augments the overall composition. The template may be a separate sheet disposed below the base plate or may be incorporated into the base plate. Additional accessories and specialized blocks are also provided.

20 Claims, 21 Drawing Sheets

(56) References Cited

U.S. PATENT DOCUMENTS

| | | | | |
|---|---|---|---|---|
| 4,014,110 | A | 3/1977 | Mayer | |
| 4,053,159 | A | 10/1977 | Kulak | |
| 4,986,756 | A * | 1/1991 | Yamaguchi | A63F 9/06 273/157 R |
| 5,048,840 | A | 9/1991 | Johson | |
| 5,106,305 | A * | 4/1992 | Grant | B44C 3/123 434/84 |
| 5,121,926 | A | 6/1992 | Pfaender | |
| 5,176,521 | A | 1/1993 | McRae | |
| 5,704,789 | A | 1/1998 | Yang | |
| 6,361,045 | B1 | 3/2002 | Bernstein | |
| 8,205,885 | B2 | 6/2012 | Latour | |
| 8,367,185 | B1 | 2/2013 | Kay | |
| 8,628,088 | B2 | 1/2014 | Sakdinan | |
| 8,827,711 | B2 | 9/2014 | Davis | |
| 9,498,703 | B2 * | 11/2016 | McCoskey | A63H 33/106 |
| 2003/0234488 | A1 * | 12/2003 | Povitz | A63F 9/1208 273/156 |
| 2005/0227573 | A1 * | 10/2005 | Lin | A63F 9/06 446/85 |
| 2009/0294610 | A1 * | 12/2009 | Paharik | A47G 1/1606 248/220.21 |
| 2010/0289215 | A1 | 11/2010 | Tan | |
| 2012/0049452 | A1 * | 3/2012 | Latour | A63F 9/10 273/157 R |
| 2012/0071061 | A1 * | 3/2012 | Smith | A63H 33/086 446/128 |
| 2016/0354705 | A1 * | 12/2016 | Poulus | A63H 33/086 |

* cited by examiner

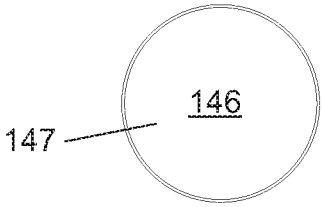
Fig. 34
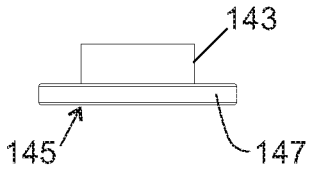
Fig. 35
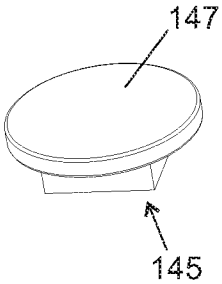
Fig. 36
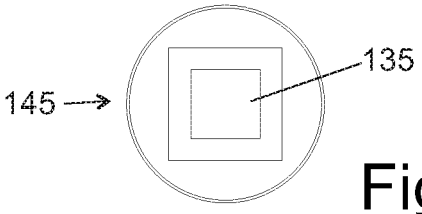
Fig. 37
Fig. 38
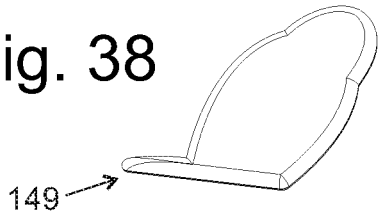
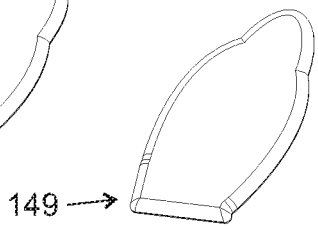
Fig. 41
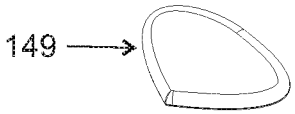
Fig. 40
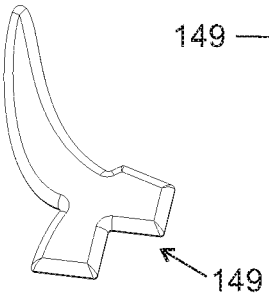
Fig. 39
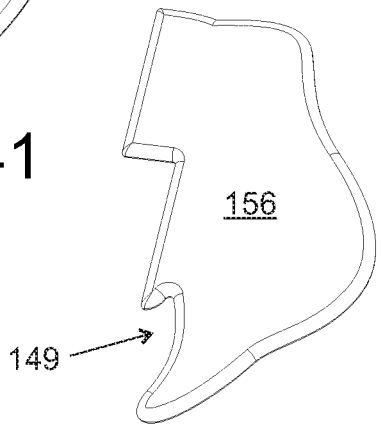
Fig. 42

THREE-DIMENSIONAL INTEGRATED, NUMERAL-DESIGNATED CONSTRUCTION CRAFT

CROSS-REFERENCE TO RELATED APPLICATIONS

This nonprovisional application claims the benefit of U.S. Provisional Patent Application No. 62/202,882, filed on Aug. 9, 2015, which is incorporated herein in its entirety.

FIELD OF INVENTION

This invention relates generally to toy construction crafts, and, more particularly, to an assembling system and method comprising a base plate for receiving building blocks, a template that includes guidance indicia to aid in placement of the building blocks to achieve a three-dimensional image, and attachable accessories.

BACKGROUND OF THE INVENTION

Toy construction crafts have an artistic and educational appeal as well as presenting an intellectual challenge. One type of construction craft is a three-dimensional (3-D) puzzle that utilizes puzzle pieces of varying thicknesses (some thinner and some thicker) and varying shapes to form a 3-D pictorial illustration. Other 3-D construction crafts are composed of associated elements that are assembled according to a pattern provided in a separate paper booklet. Though conventional toy construction crafts may serve to meet particular requirements, there remains the need for a new, innovative construction set that engages and entertains, while challenging the child's imagination and skills.

Accordingly, there is a need for a construction craft that provides new construction elements along with an innovative method of assembly to create an aesthetically pleasing and vertically-displayable final assemblage, thereby increasing the interest, entertainment, and educational value of the toy to the child user.

BRIEF SUMMARY OF THE INVENTION

The present invention is directed to a construction craft which provides for attachment of modular building blocks to form a 3-D puzzle portion of an assembled composition and which also incorporates additional construction elements to amuse the user by presenting further complexities to be solved by following the assembly instructions. All of the construction elements are affixed or adhered to the finished assemblage, thus producing a completed construction creation that is vertically displayable, such as on a wall. After completion of the construction craft, the construction elements may also be detached, providing repeat play value.

The displayable construction craft comprises the following construction elements: a base plate, a template (which may be a sheet for placement below a transparent base plate or may be incorporated into the base plate), building elements including modular building blocks attachable to the base plate that create a 3-D constructed area, one or more graphic segments providing background or adding artistic enhancement to the 3-D constructed area, and, preferably, a frame for consolidating the other construction elements.

The base plate is configured with upwardly-extending projections or male studs for receiving building elements with female coupling structures corresponding to, and attachable to, the male studs. The building elements may include standard modular building blocks, specialized platform-topped building blocks with associated ornamental platform elements, and pop-out decorative pieces, all of which cooperate to create the 3-D creative design.

The template is configured with at least one designation area of guidance indicia. In the aspect in which the template is a discrete sheet positioned below the base plate, each guidance indicium is viewed through the transparent base to inform the user through at least a numeral designation as to the height of the designated modular block or blocks that will be used on that particular projection. Preferably, a particular guidance indicium disposed below a particular projection also informs the user through a color designation of the proper color of the particular designated modular block to attach to the particular projection. The combination of multiple ones of the designated blocks forms the 3-D portion of the artistic composition, while the graphic segment(s) augments the overall composition, such as by providing background graphics. In this aspect with a separate template sheet, the first template sheet is exchangeable with other template sheets that provide directions for different designed patterns. Thus, in this aspect, the base plate is usable with multiple templates.

In the aspect in which the template is incorporated into the base plate, the guidance indicia function the same, but are inscribed, printed, imprinted or otherwise displayed on the base plate itself. In this aspect, the designated pattern is incorporated into the base plate, so to construct a different design, a different base plate that incorporates guidance indicia designating the different design is required.

The graphic segment or graphic segments are fitted around or adjacent to the constructed 3-D portion of the artistic composition.

The frame secures the base plate, discrete template, and graphic segment in place to allow the completed artistic composition to be built. Upon completion, an optional hanger also allows the user to conveniently hang the construction craft.

This 3-D numeral-designated construction craft provides unique integrated construction elements with a new method of assembly that utilizes more imagination and ingenuity than traditional two or three-dimensional puzzles and that, when completed, provides a more aesthetically pleasing artistic creation than traditional building block assemblages. Therefore, the educational and entertainment value are increased over conventionally provided puzzles and construction crafts.

Advantages of the three-dimensional integrated numeral-designated construction craft include the dimensionality of the complex finished art, the interesting mixed-media combinations of graphics with building blocks and other building elements, and the interesting yet straightforward method of assembly. The method of combining the colored images of the graphic segments with building elements is unique and enables the overall created artwork to be a smaller size than it could otherwise be without losing image details, which would occur if a constructed composition were to be built entirely of building blocks giving a bitmap effect. Optional building elements include flat platform-topped blocks that can receive flat-bottomed ornamental platform elements to add yet another artistic medium, adding to the creative aspect of the invention.

An object of the present invention is to provide a three-dimensional integrated numeral-designated construction craft that integrates mixed media in creating an artistic composition, thereby increasing interest, educational, and entertainment value.

These and other objects, features, and advantages of the present invention will become more readily apparent from the attached drawings and from the detailed description of the preferred embodiments which follow.

BRIEF DESCRIPTION OF THE SEVERAL VIEWS OF THE DRAWINGS

The preferred embodiments of the invention will hereinafter be described in conjunction with the appended drawings, provided to illustrate and not to limit the invention, where like designations denote like elements.

FIGS. 34-37 are top, side, top perspective and bottom views of the platform-topped block, respectively.

FIGS. 38-42 are exemplary designs of ornamental platform elements.

Like reference numerals refer to like parts throughout the several views of the drawings.

DETAILED DESCRIPTION OF THE INVENTION

Figure 1:
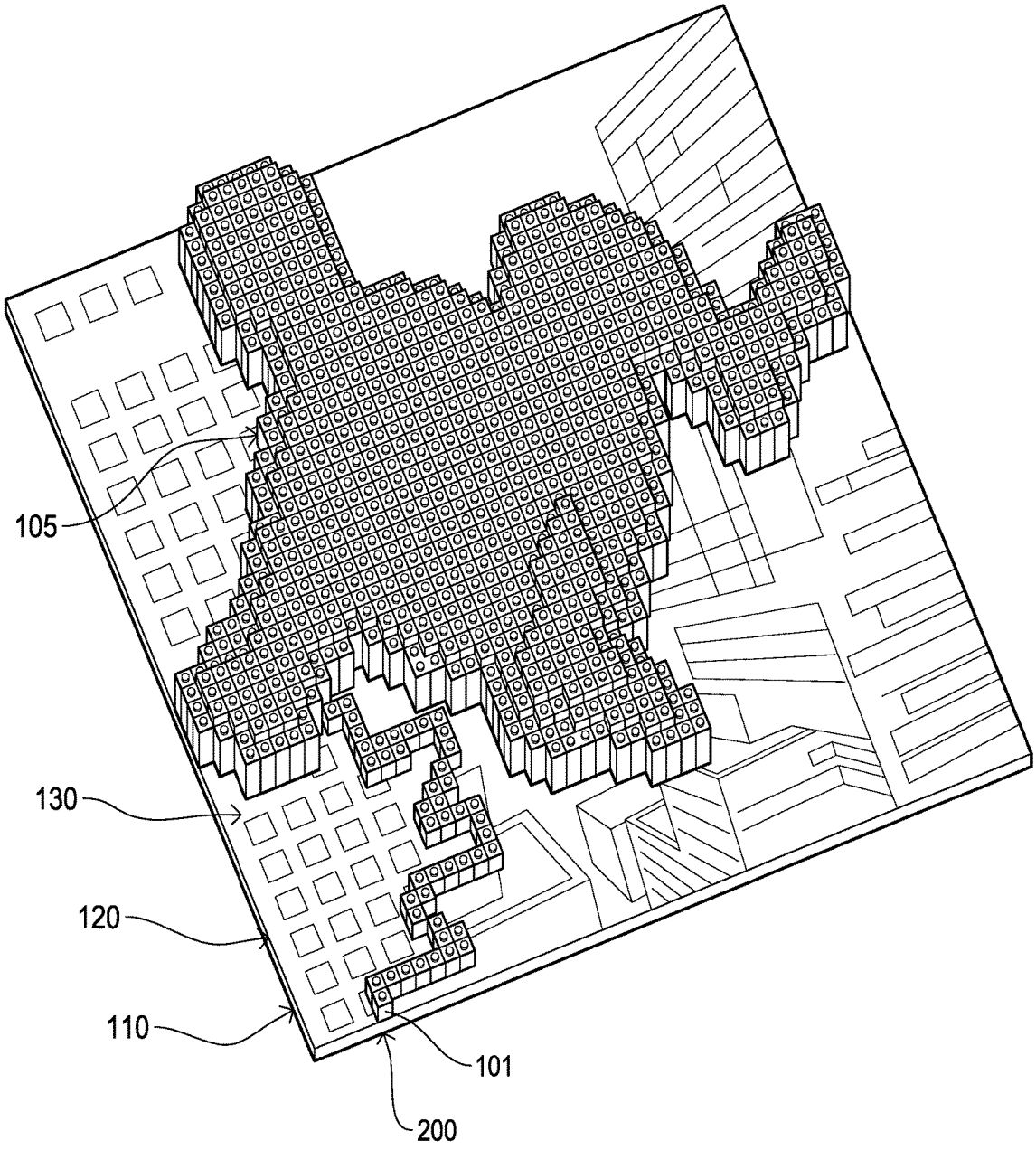
FIG. 1 is a top perspective view of the basic first embodiment of the three-dimensional integrated numeral-designated construction craft of the present invention.

Shown throughout the figures, the present invention is directed toward a three-dimensional numeral-designated construction craft integrating multiple construction elements. The construction elements include a template 110, a base plate 120, at least one graphic segment 130, an optional frame 150, an optional separable hanger 140, and building elements 200. The building elements 200 include standard modular building blocks 101 and, optionally, pop-up decorative pieces 303 and/or platform-topped blocks 145 with associated ornamental platform elements 149, which cooperate to create the design of the 3-D structure 105.

The three-dimensional integrated numeral-designated construction craft herein presented provides an activity or craft that, when assembled, creates a dimensional work of art or dimensional artistic composition or creation that can be vertically displayed.

Four embodiments are presented. All embodiments include the base plate 120, template 110 configured with guidance indicia 113 (FIG. 3) designating the proper modular building block 101 to create the 3-D design, and at least one graphic segment 130 for positioning above the base plate 120. In all embodiments, the user builds on top of the base plate 120 using building elements 200 (which include at least standard modular building blocks 101 and, optionally, pop-up decorative pieces 303 and/or platform-topped blocks 145 with associated ornamental platform elements 149), with the modular building blocks 101 positioned in a manner designated by the guidance indicia 113 carried by the template 110. Two types of hangers 165 are provided, a frame-integrated hanging feature 151 and a separable hanger 140. Two aspects of the template 110 are provided, one in which the template 110 is a discrete template sheet used with a transparent base plate 120, and one in which the template is integrated into the baseplate.

FIGS. 1-5 present a basic first embodiment in which the user builds on top of the transparent base plate 120 using a combination of graphic segments 130 and modular building blocks 101.

The second embodiment is shown in FIGS. 6-18. The second embodiment includes the elements of the first embodiment, but also adds a multi-piece frame 170.

The third embodiment is shown in FIG. 19-29. The third embodiment includes the elements of the first embodiment, but also includes at least one pop-up decorative piece 303 and a second frame variation.

The fourth embodiment is shown in FIGS. 30-53. It includes the elements of the first embodiment with the addition of a third frame variation and the addition of platform-topped blocks 145 for receiving ornamental platform elements 149.

Figure 2:
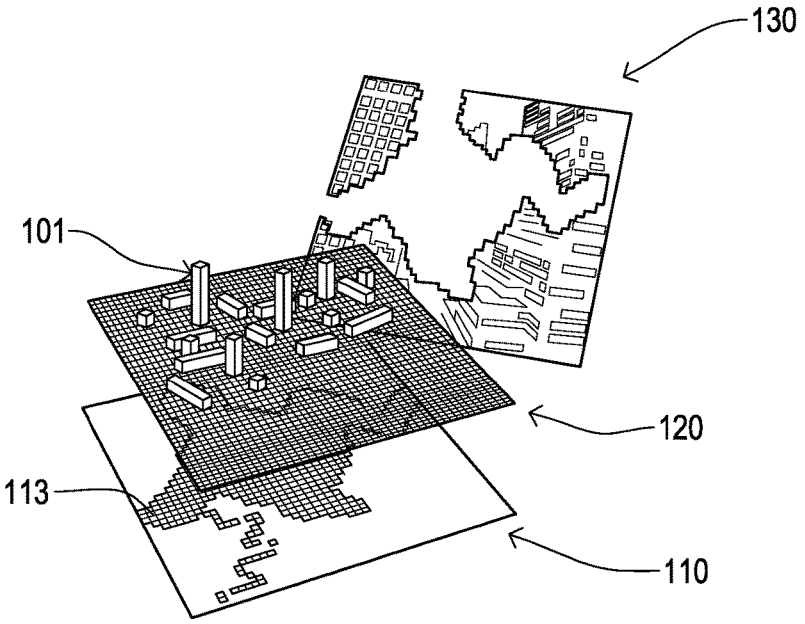
FIG. 2 is an exploded perspective view of the first embodiment of the present invention showing the discrete template aspect.

Turning to FIGS. 1-2, the toy base plate 120 has an upper flat surface configured with upwardly-projecting male elements, projections, or studs 125 upon which a plurality of modular building blocks 101 are to be assembled based on the instructions provided at least by the guidance indicia 113 disposed in a designation area of the template 110.

The base plate 120 comprises a rigid or partially rigid sheet or flat base that provides a substantially planar building surface arranged with a number of upwardly-protruding male coupling studs 125 for being interconnected with toy building elements 200 having complementary female coupling structures 135. The male coupling studs 125 are preferably arranged on the same side of the base plate 120 in equidistant rows.

In the aspect in which the template 110 is a discrete template sheet, shown in FIG. 2, the base plate 120 is necessarily transparent to allow viewing of the guidance indicia 113 on the template sheet positioned below the base plate 120. In the aspect in which the template 110 is integrated into the base plate 120, shown in FIG. 4, the guidance indicia 113 are applied to the base plate 120.

The standard toy modular blocks 101 are preferably formed of plastic material. They are configured with downward-opening female coupling structures 135 configured to fit onto the male studs 125 and are configured with upwardly-extending studs 125 that can accommodate a downward-opening female coupling structure 135 of another modular block 101. The female coupling structures 135 are sized and configured to coordinate with the male studs 125, but may be in any of a variety of shapes. For example, the female coupling structures 135 may be open cells (as seen in the modular building blocks 101 of FIG. 50), may be formed with ribs inside cylinders, may be formed in any of various shapes (such as the square cells of platform-topped blocks of FIGS. 37, 50), may be formed with or without ribs touching the outside of the male studs 125, or may be otherwise designed to frictionally connect onto the male studs 125.

Figure 3:
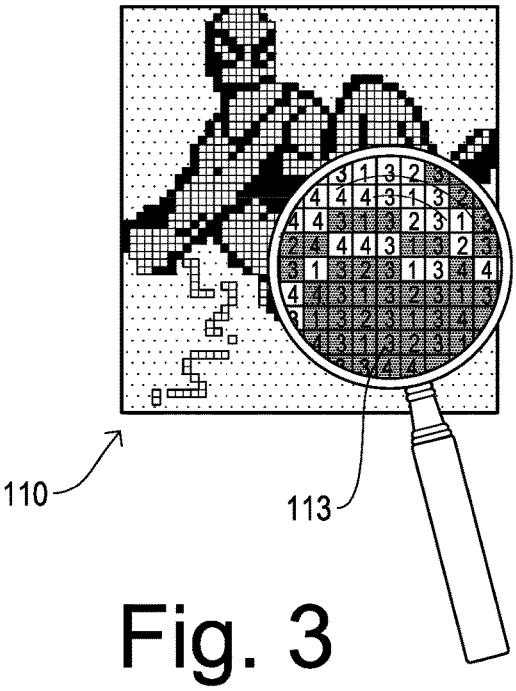
FIG. 3 is a top view of the first embodiment of the present invention that includes a magnified portion.
Figure 4:
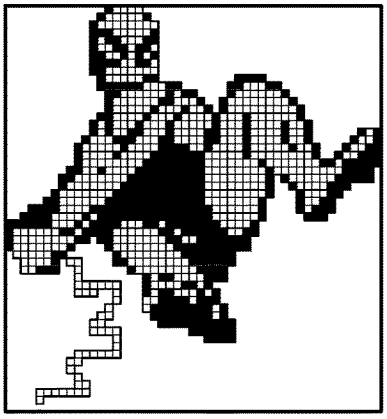
FIG. 4 is a top view of the base plate of the first embodiment of the present invention showing the base plate-integrated template aspect.

In the aspect shown in FIG. 3, the template 110 is a separate sheet configured with guidance indicia 113 that, for each male stud 125, inform the user of the height of the modular block 101 to select (when the modular blocks 101 are provided in varying heights) and/or how many single unit modular blocks 101 will need to be stacked to achieve the designated height, which will then be attached to the particular upwardly-projecting stud 125 of the base plate 120. The user can view the template 110 below the base plate 120, because the base plate 120 is transparent. In a first aspect, the template 110 is a full color template. In this aspect, the guidance indicia 113 provides a color to instruct a color pattern to follow and provides numbers instructing a dimensional pattern to follow; the provided guidance enables the user to build on top of the base plate 120 to create proper dimensions for the 3-D portion 105 of the craft. Additionally, the template sheet 110 may also indicate, by way of graphic design and/or die line, the location into or onto which the graphic segments 130 are to be placed.

Figure 5:
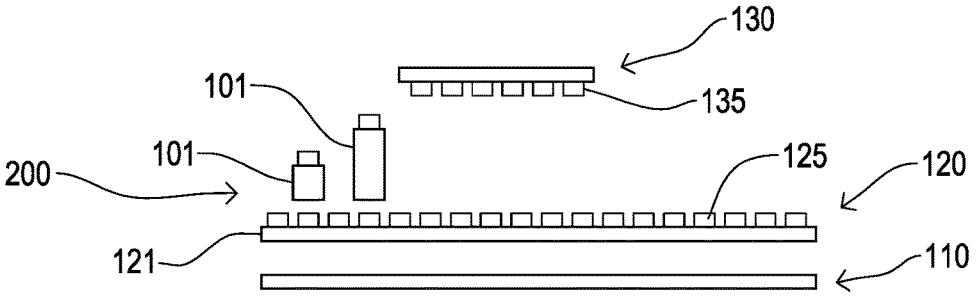
FIG. 5 is a side view of the first embodiment of the present invention.
Figure 6:
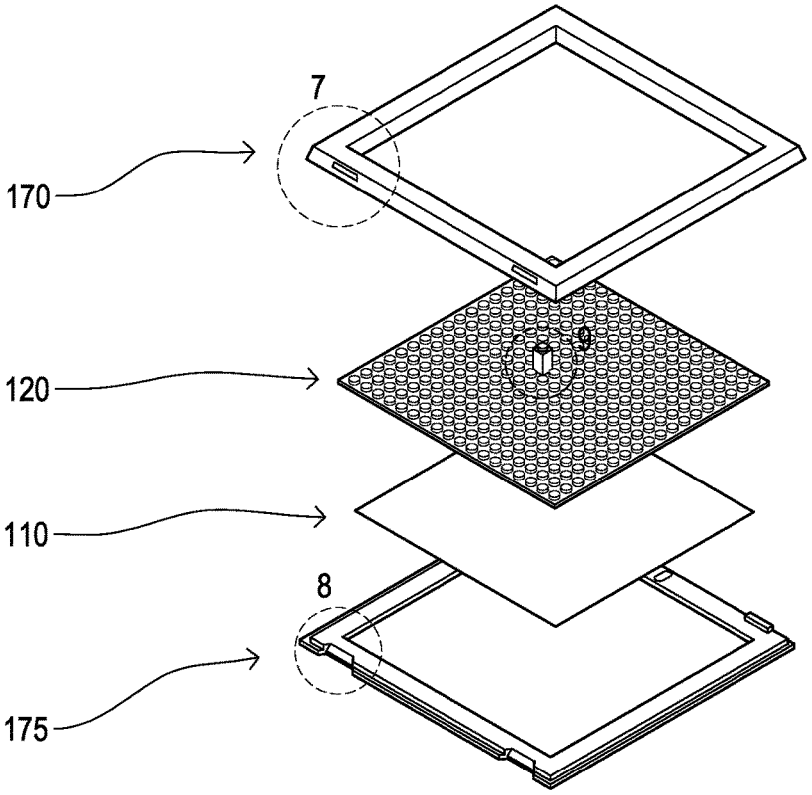
FIG. 6 is an exploded top perspective view of a second embodiment of the present invention that provides a first frame variation added to the elements of the basic first embodiment.
Figure 7:
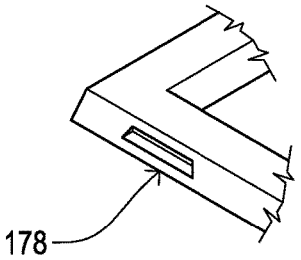
FIG. 7 is a detail view of circle 7 of FIG. 6.
Figure 8:
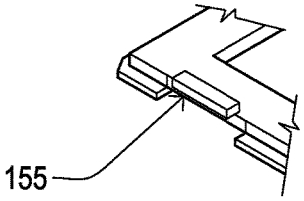
FIG. 8 is a detail view of circle 8 of FIG. 6.
Figure 9:
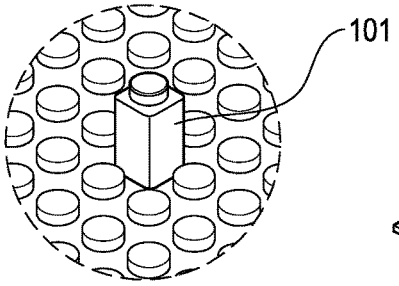
FIG. 9 is a detail view of circle 9 of FIG. 6.

In an example, if there is a blue square that includes a number "3" on the template sheet 110 that is immediately below a particular stud 125 on the transparent base plate 120, the user selects (as seen in FIG. 5) a three-high blue block 101 or three one-high blue blocks 101 (with the three blocks 101 stacked to achieve the three-high designation of the template) and places the blue block(s) having a height of "3" on that particular stud 125 on the transparent base plate 120. After the user places the first block 101 of appropriate color and height onto the upward projection, the user then notes the guidance indicium 113 below another blue stud, and the user selects the next correct block or blocks 101, and on and on, to create a pre-determined 3-D constructed structure 105 of blocks 101 in one or more areas of the base plate 120.

In some aspects, the guidance indicia 113 may have both the number designation (indicating to the user how high to stack the blocks) and color designation (indicating to the user what colors of blocks to stack) on one side of the template sheet 110. In other aspects, the template 110 may have guidance indicia 113 on both the top and bottom, such as a number designation on the top of the template sheet 110 and a color designation on the bottom surface of the template 110, or vice versa. In another aspect, the guidance indicia 113 may only provide numerical designations.

In the aspect in which the template 110 is integrated into the base plate 120, the guidance indicia 113 functions in the same manner.

Figure 12:
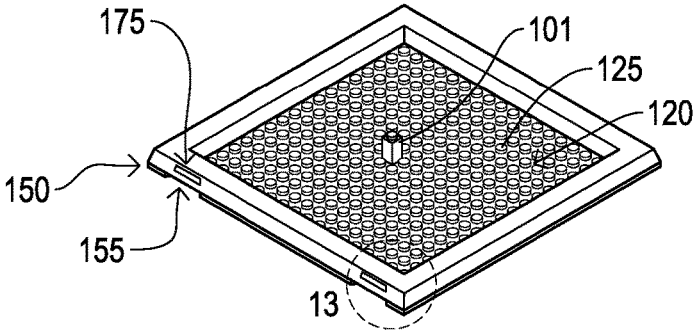
FIG. 12 is a top view of a partially assembled system of the second embodiment of the present invention, with the template sheet and transparent base plate secured by the frame and ready for the user to build upon and the with the first block placed on the base.
Figure 19:
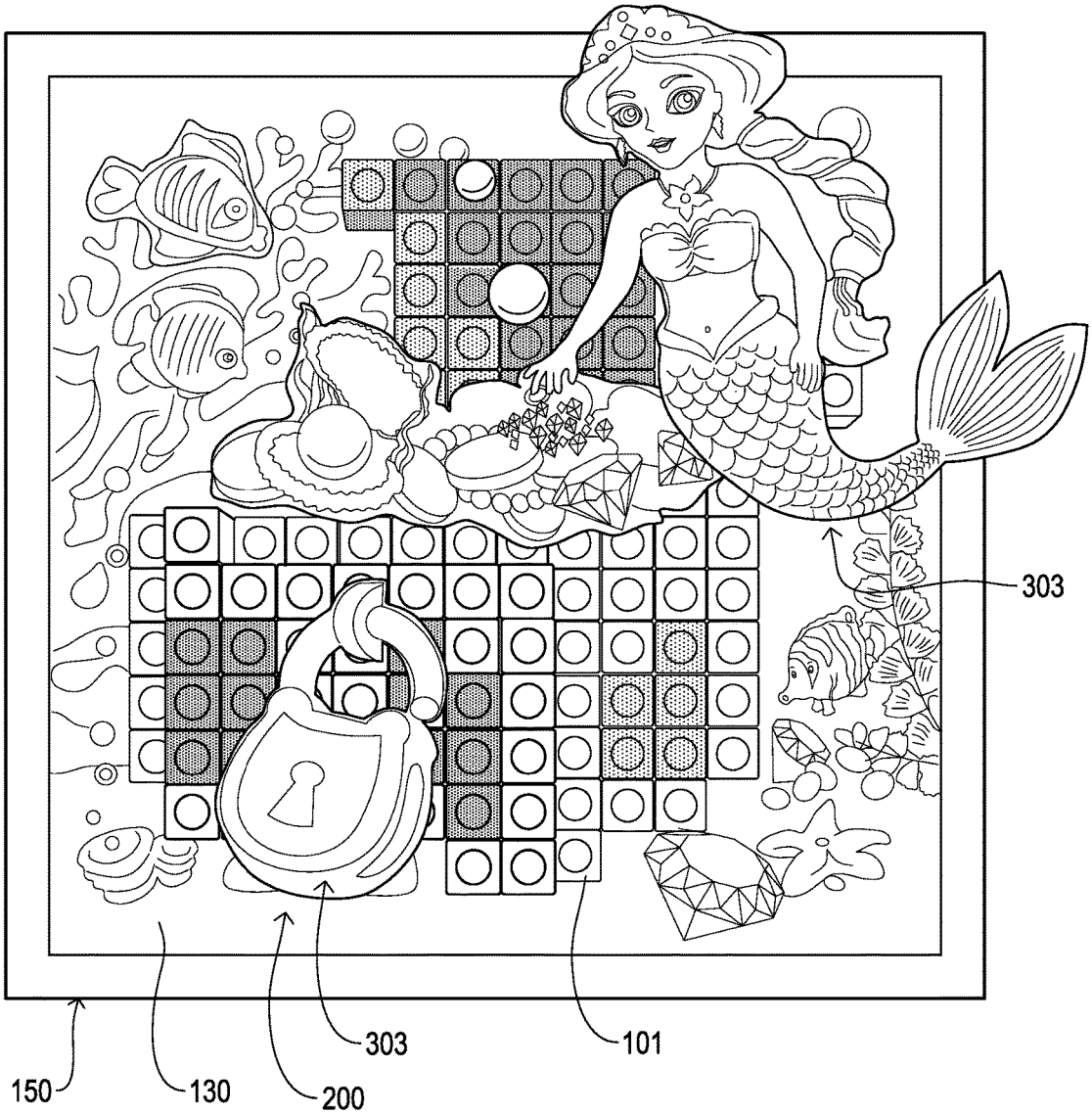
FIG. 19 is a top view of an exemplary assembled system of the third embodiment of the present invention, which includes a second frame variation and added pop-up decorative pieces building elements.

The graphic segment 130 is preferably a flat sheet (such as cardboard, paperboard, or laminated paper) with a decorative graphic printed, embedded, embossed, imprinted, adhered to, or otherwise embellishing the top surface of the graphic segment 130. The graphic segment 130 may be a single segment, but may be formed of multiple segments, as seen in FIG. 2. In the first embodiment, the graphic segment 130 is configured with downward-facing female coupling structures 135 as shown in FIG. 5 for engagement with the base plate 120. In another aspect (in embodiments that include a frame 150), the graphic segment 130 may be held in place through interaction with, or capture by, the frame 150 (FIG. 12). The graphic segment(s) 130 are used on top of the base plate 120 along with the blocks 101. The graphic segment(s) 130 fit around the outside edges of the block grouping and/or among or between the blocks to form a suitable background and/or an illustration continuing or complimenting the block-constructed 3-D portion 105 of the three-dimensional integrated numeral-designated construction craft. (Though shown diagrammatically in FIG. 20 with a rectangular inner edge, typically the graphic segment(s) 130 would be irregular to fit the construction craft design theme, as seen in FIGS. 2, 19.) These graphic segments 130 advantageously enable the block-constructed 3-D portion 105 of the image to appear to have organic shaped edges so that the eye is not limited to seeing straight edges, as would be the case if only blocks were used.

Figure 13:
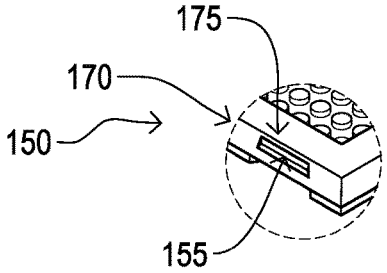
FIG. 13 is a detail view of circle 13 of FIG. 12 of a frame closure mechanism of the second embodiment of the present invention.
Figure 15:
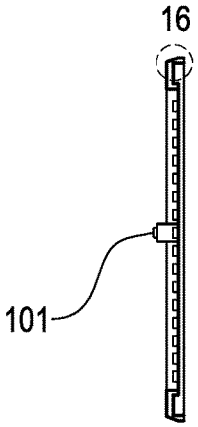
FIG. 15 is a side view of a partially assembled system of the second embodiment of the present invention.
Figure 14:
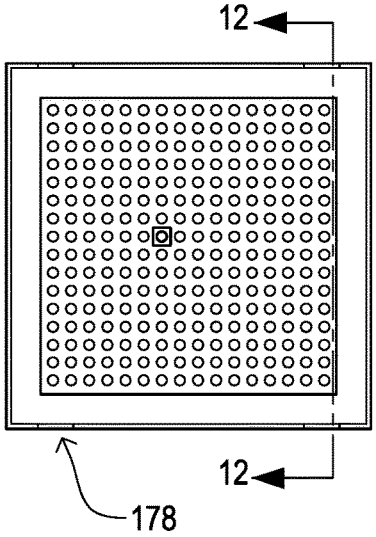
FIG. 14 is a top view of the second embodiment of the present invention with the first block placed on the base.
Figure 16:
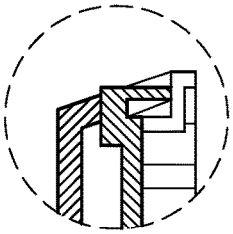
FIG. 16 is a detail view of circle 16 of FIG. 15 of the second embodiment of the present invention.

Turning to the second embodiment of FIGS. 6-18, a multi-piece frame 150 (FIG. 12) supports the transparent base plate 120, template sheet 110, and at least one graphic segment 130. In this embodiment, the frame 150 has at least an upper frame portion 170 and a lower frame portion 175, which are attachable together. For example, the attachment can be provided by a male snap portion 155 (FIG. 8) that can be manually connected to the female snap portion 178 (FIG. 7) to form the completed frame 150. FIGS. 12-13 show the assembled frame 150 with the male snap portion 155 engaged with the female snap portion 178.

Figure 10:
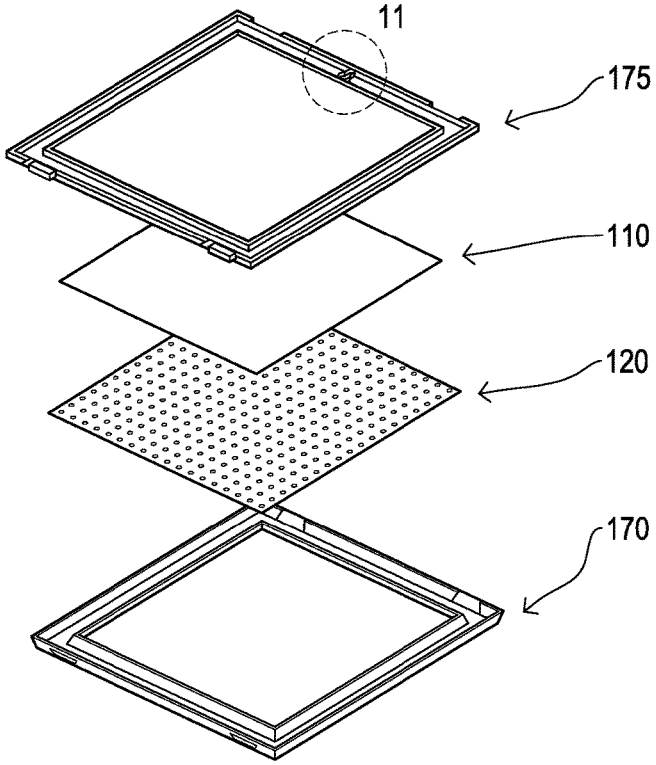
FIG. 10 is an exploded bottom perspective view of the second embodiment of the present invention.
Figure 11:
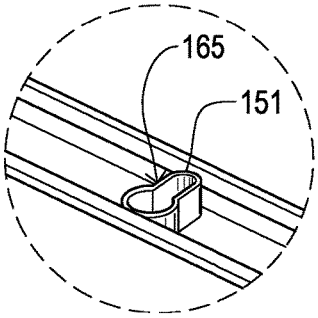
FIG. 11 is a detail view of circle 11 of FIG. 10 of the second embodiment of the present invention showing a frame-integrated hanger.

The exploded view of FIG. 10 is inverted with the lower frame portion 175 facing upward to reveal a hanger 165, which in the second embodiment may be a frame-integrated hanging feature 151 (FIG. 11). The hanging feature 151 may be a hook, a keyhole or another standard hanging mechanism, as is known in the art. The hanging feature 151 may be disposed within the structure of the frame 150; for example, it may be created by incorporating the hanging feature 151 within the mold used to form the frame 150.

Figure 17:
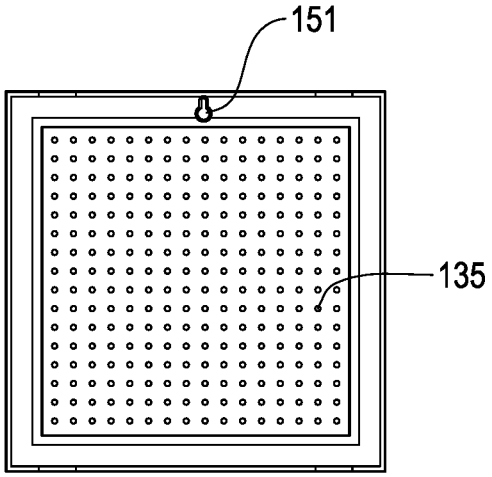
FIG. 17 is a bottom view of the assembled frame of the second embodiment of the present invention.
Figure 18:
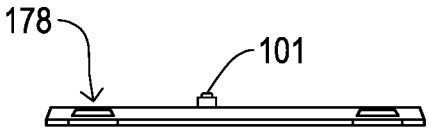
FIG. 18 is a side view of FIG. 17.

FIG. 17 shows a back view of the back of the frame 175 and back of the base plate 120. Optionally, the base plate back surface may be smooth (not shown), configured with indentions opposing the male studs 125 of the front surface (as shown), or may be configured with female coupling structures 135 identical to the female coupling structures 135 of the modular blocks 101.

Figure 23:
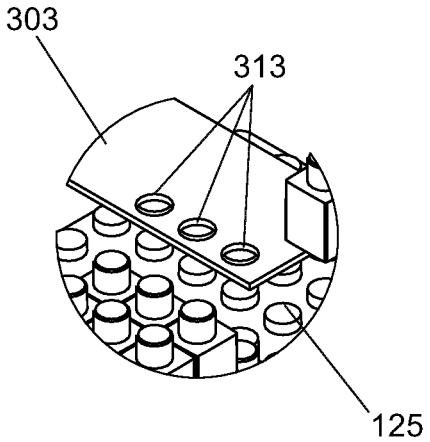
FIG. 23 is a detail view taken from circle 23 of FIG. 20.

FIG. 19 shows the pop-up decorative piece(s) 303 of the third embodiment, which may be utilized with the other embodiments. The one or more pop-up decorative pieces 303 complete the artistic composition with added dimensionality. The pop-up decorative pieces 303, can be attached in various ways. In one aspect, the pop-up decorative piece(s) 303 can be configured with attachment holes defined by attachment hole edges 313 (FIG. 23). The upwardly-projecting base studs 101 or block studs 302 (FIG. 20) protrude through the attachment holes defined by attachment hole edges 313; then an additional modular block 101 can be placed on top of the pop-up decorative piece 303 to secure it. In another aspect, the pop-up decorative piece(s) 303 may be applied by the user with adhesive, glue dots, or tape on top of the modular blocks 101 and/or on top of the graphic segment(s) 130 to complete the 3-D picture composition. This is advantageous because the construction is simplified compared to creating all graphic elements out of modular blocks 101, yet the integrity of the design image is maintained. In another aspect, the pop-up decorative pieces 303 physically extend above and beyond the edge of the frame 150 to visually break out of the frame 150, thereby providing a visual enhancement to the overall dimensional artistic composition of the construction craft.

Figure 20:
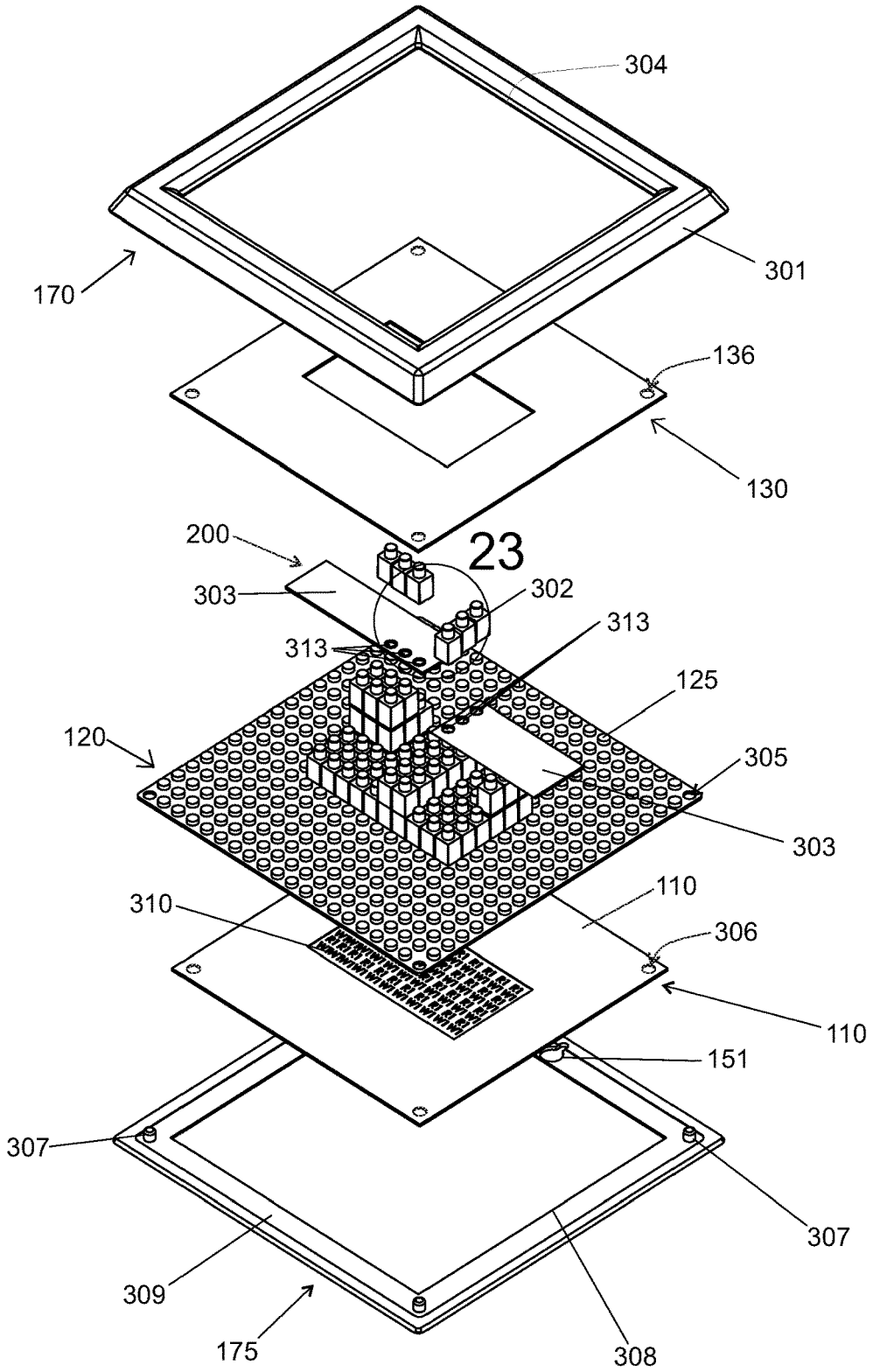
FIG. 20 is a diagrammatic exploded perspective view of a third embodiment of the present invention.

FIG. 20 is an exploded view of the elements used to create the dimensional artistic composition of the third embodiment. The frame 150 includes a lower frame portion 175 and an upper frame portion 170. Both the upper and lower frame portions 170, 175 are preferably formed of plastic. The upper frame 170 has an inner edge 304 defining a viewable opening and an outer edge 301. In one aspect, the lower frame 175 also has an interior opening defined by inner edge 308, while in a different aspect, the lower frame 175 extends fully from side to side to form a complete back frame portion. The lower frame 175 is attachable (preferably removably attachable) to the upper frame 170. For example, the lower frame 175 may be configured with multiple pegs 307 (FIG. 20) that are received by female receiving elements, whereby the pegs 307 of the lower frame 175 may be snapped into the female receiving elements of the upper frame 170.

The pop-up decorative piece or pieces 303 are building elements that are attachable to modular blocks 101 that are already attached to the base plate 120; they add an elevated graphical or illustrative presentation that enhances the artistic design of the construction craft. The pop-up decorative pieces 303 are preferably formed of cardboard or paperboard that may or may not be laminated or may be formed of printed or unprinted plastic. The preferably full-color graphical adornment of the top surface of the pop-up decorative pieces 303 may be achieved by printing, imprinting, inscribing, embossing, adhering of a graphical decal or label, lamination with graphics, or otherwise embellishing the top surface.

The pop-up decorative piece 303 is designed to fit between two horizontal layers of modular blocks 101. In one aspect, when a pop-up decorative piece 303 goes between two horizontal layers of modular blocks 101, it is configured with attachment holes defined by hole edges 313 (FIG. 23) to receive the upward studs 302 on the blocks 101 and/or upward projections 125 on the base plate 120. In another aspect, adhesive, tape or glue dots may be used to attach the pop-up decorative pieces 303 onto the top of the blocks 101 or graphic segments 130; in this instance, the pop-up decorative piece 303 need not be configured with holes 313. Optionally, the pop-up decorative piece 303 may be configured with downward-facing female coupling structures 135 to connect to upward-facing studs 125 of the blocks 101 or of the base plate 120.

In this third embodiment, the clear plastic base plate 120 is configured with upward projections 125 and with multiple alignment holes 305, which could be in or near the corners of the base plate 120. One alignment hole 305 is shown in FIG. 20 in each corner of the base plate 120. Each alignment hole 305 is configured to accommodate a peg 307 extending upwardly from the frame corner. Though the illustration of FIG. 20 shows pegs 307 and alignment holes 305 in each corner, other locations are within the scope of the invention. Each alignment hole 305 is manually fitted onto each of the pegs 307 of the base. The pegs 307 may be disposed on the upper or lower frame, but are shown on the lower frame. Similarly, the template sheet 110 may be configured with alignment holes 306. The pegs 307 will help hold the template sheet 110, base plate 120, and any structures built upon the base plate 120 in place during play. To assemble the frame 150, the pegs 307 are inserted through the alignment holes 306 on the template sheet 110, the holes 305 on the studded base plate 120 and through holes 136 on the graphic segments 130 to finally snap into the upper frame portion 170.

In this embodiment, the template sheet 110 is shown with an unnumbered and undesignated border 114 and with a designation area 310 displaying guidance indicia 113. In another aspect, the template sheet 110 need not be integrated into the construction craft, but may merely be placed beside the construction craft unit and used as an instruction manual. In another aspect, the template 110 is integrated into the base plate 120 with the color and numeral designations applied directly to the base plate 120, which then does not need to be clear.

In FIG. 20 a single graphic segment 130 is shown, but optionally multiple graphic segments 130 can be used. The graphic segments 130 are fitted together following along the edge or edges of the built-up modular blocks 101, which necessarily have straight edges. The graphic segments 130 extend outward from the straight edges abutting the blocks toward or, preferably, past the frame 150.

Figure 21:
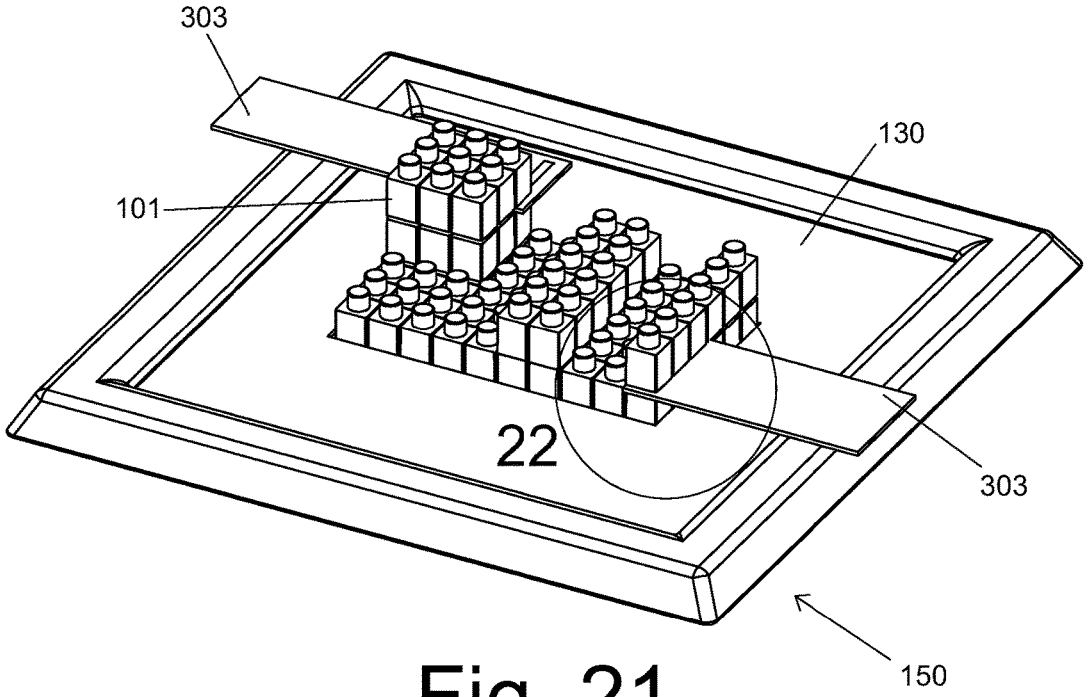
FIG. 21 is a diagrammatic perspective view of the third embodiment of the present invention that is at least partially assembled.
Figure 22:
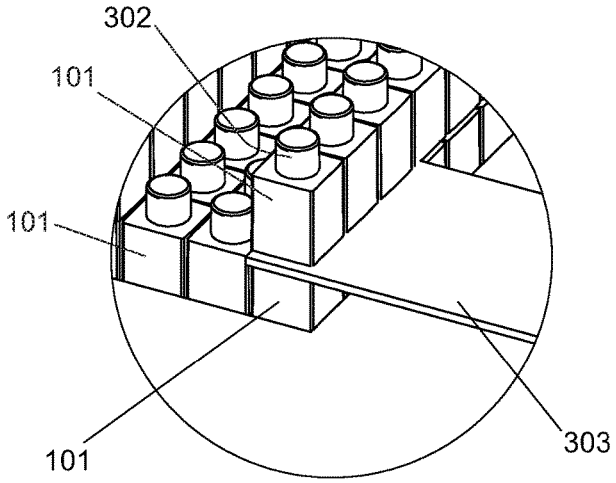
FIG. 22 is a detail view taken from circle 22 of FIG. 21.

FIG. 21 is a perspective view of a partially assembled artistic composition in its frame 150 with graphic segments 130 in place, with some blocks 101 stacked, and with two pop-up decorative pieces 303 fitting between two layers of blocks on different levels. It also shows how pop-up decorative pieces 303 can extend beyond the outer limits of the frame 150 or "break out" of the frame 150. FIG. 22 is a detail of FIG. 21 showing the stacking of the modular blocks 101 with the pop-up decorative pieces 303 between them.

Figure 25:
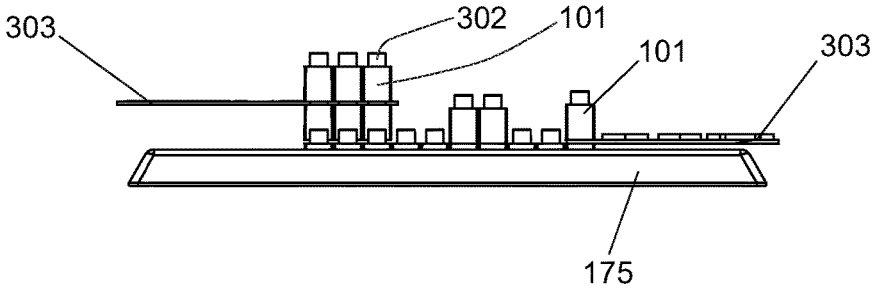
FIG. 25 is a diagrammatic side view of FIG. 24.

The detail of FIG. 23 shows the attachment holes defined by hole edges 313 on a pop-up decorative piece 303 that are to be fitted onto the studs 302 of the modular blocks 101. In another aspect, the holes 313 can fit onto the similar studs 125 on the plastic base plate 120, as seen in FIG. 25

Figure 24:
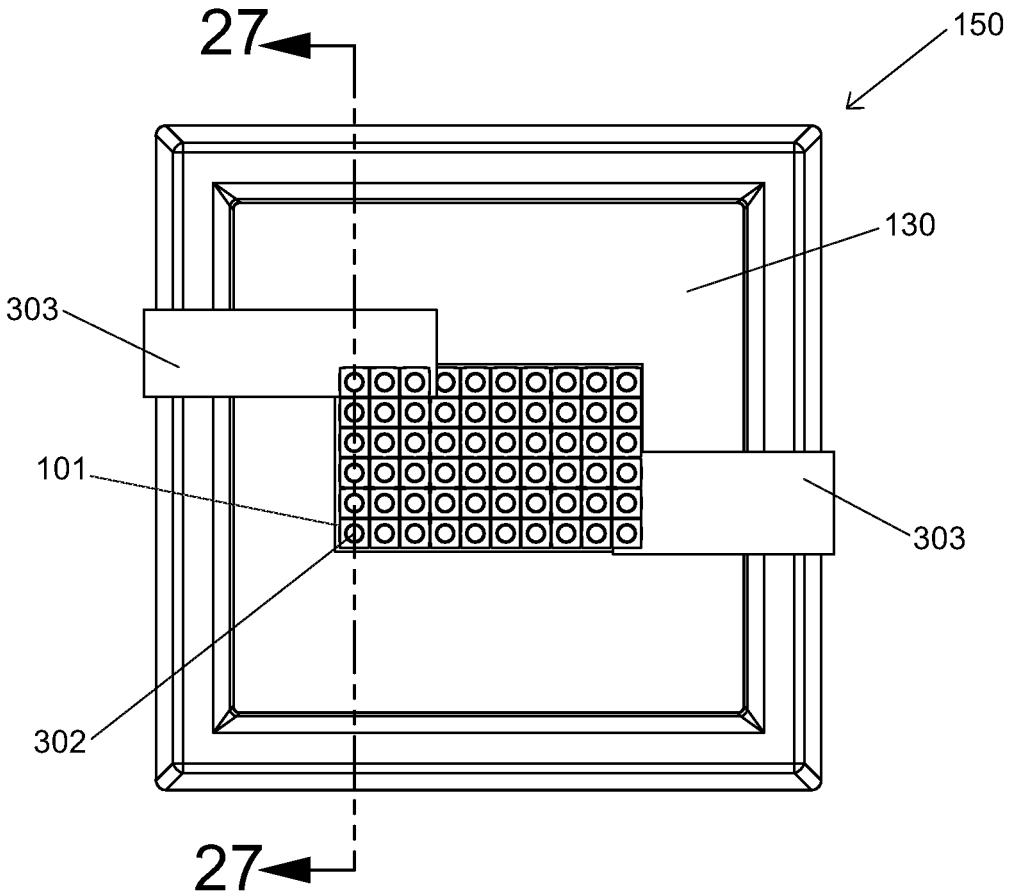
FIG. 24 is a diagrammatic top view of the third embodiment of the present invention.

FIG. 24 is a top view of the assembled artistic composition illustrating that pop-up decorative pieces 303 may extend beyond the front of the front portion 170 of the frame 150.

Figure 26:
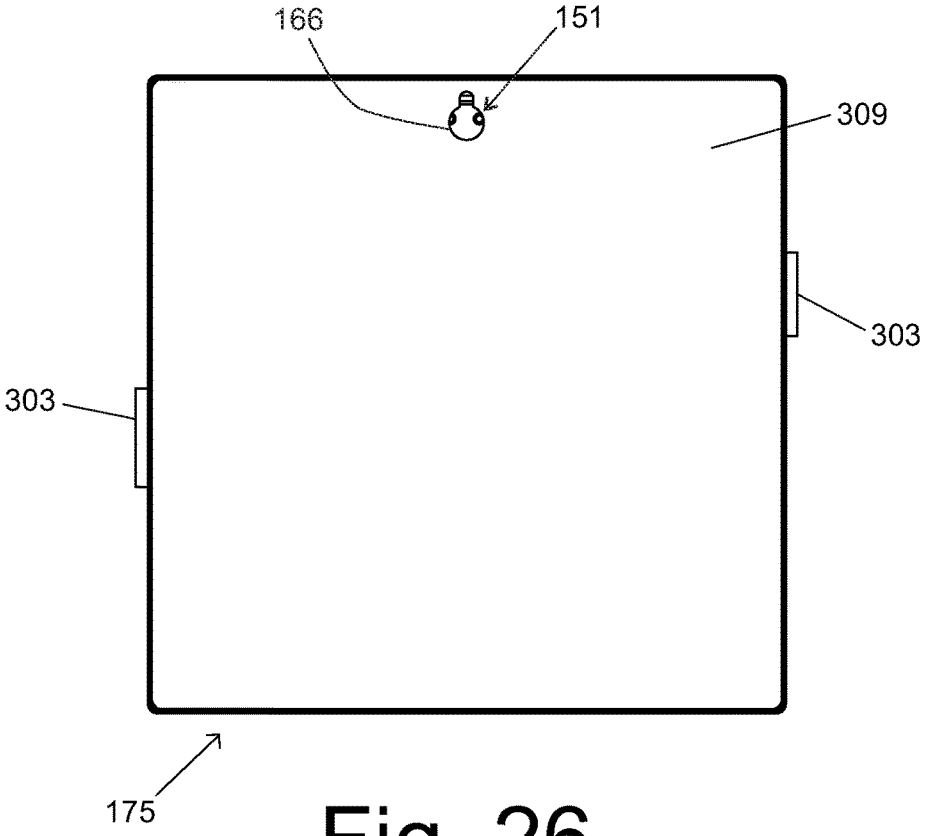
FIG. 26 is a diagrammatic bottom view of FIG. 24.
Figure 27:
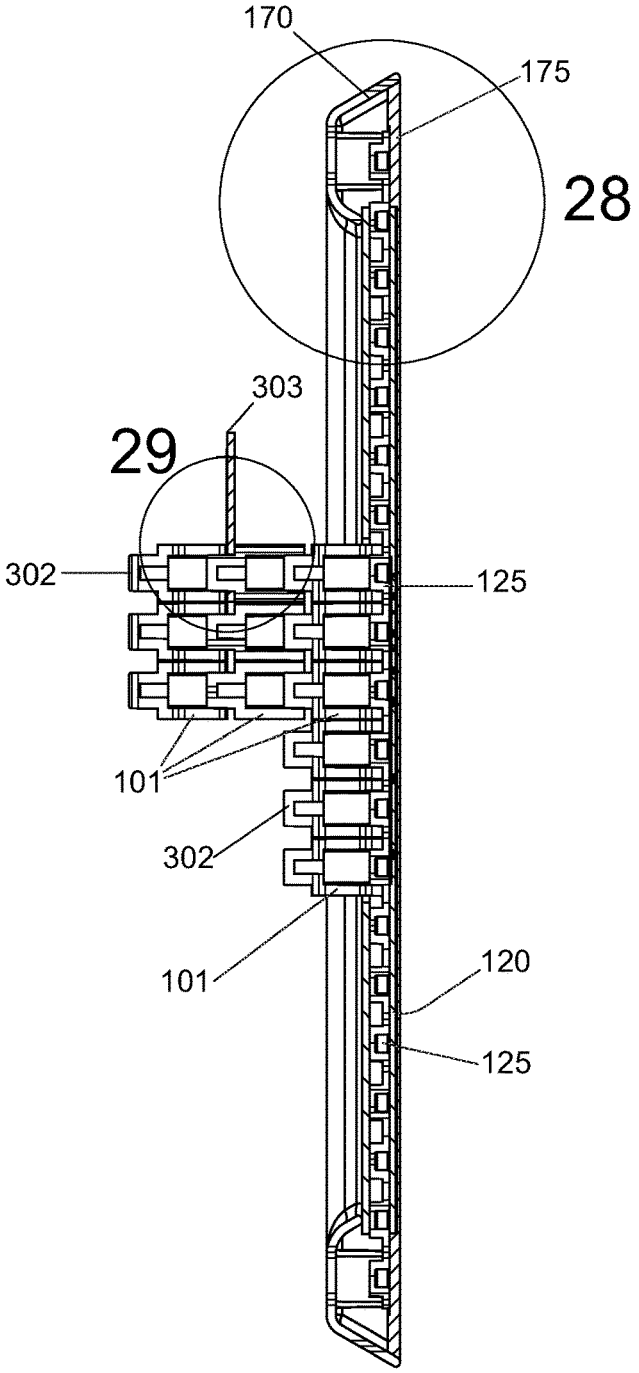
FIG. 27 is a diagrammatic cut view looking along line 27 of FIG. 24 of the third embodiment of the present invention.
Figure 28:
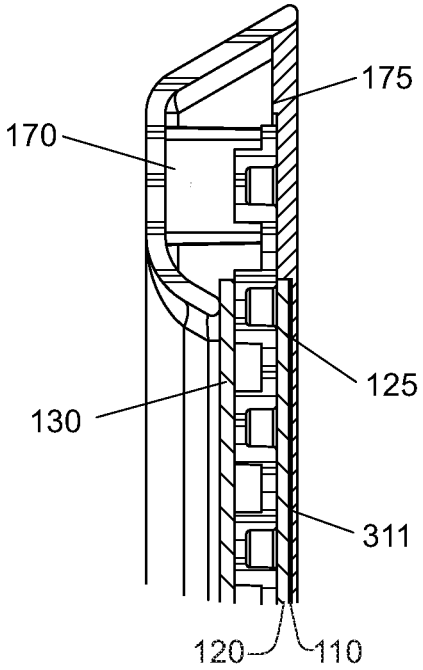
FIG. 28 is a detail view taken from circle 28 of FIG. 27.
Figure 29:
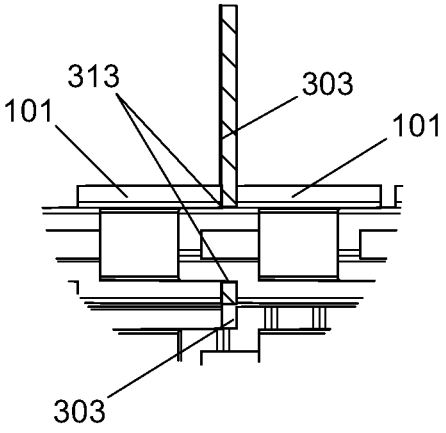
FIG. 29 is a detail view taken from circle 29 of FIG. 27.

The frame hanging feature 151 shown in the back view of FIG. 26 is of the keyhole type defined by edges 166. This frame hanging feature 151 will enable the user to hang the finished artistic composition. Preferably the frame hanging feature 151 is molded into the plastic of the lower frame 175. Also, in the aspect shown in FIG. 26, the lower frame 175 provides a full back sheet without an interior opening.

To use the third embodiment of the invention, the user first assembles construction elements to create a foundational play surface structure onto which the removable and replaceable building elements 200 will be attached to create the artistic composition. To create the foundational structure, the user places lower frame 175 onto a surface for support, and then places the template sheet 110 into the frame recess 309 (FIG. 20). A clear plastic base plate 120 is then situated above the template sheet 110. Graphic segments 130 are situated above the base plate 120. Preferably all of these pieces have alignment holes 306, 305, 136 that are manually placed over pegs 307 of the lower frame 175. Then the upper frame portion 170 is engaged with the lower frame portion 175 to create a robust framed play surface structure for receiving blocks 101 and any pop-up decorative pieces 303 of the particular pre-determined design.

The user then looks at the guidance indicium 113 within the designation area 310 of template sheet 110 below a particular stud 125 to determine which modular block 101 is designated by the guidance indicium 113 to fit the pre-determined design. For example, a block 101 of the correct height and color is designated. This step is repeated with the other guidance indicia 113, adding blocks 101 as needed to complete the 3-D block construction 105 (FIG. 1) of the pre-determined design pattern. The graphic segments 130 are fitted around the block-constructed 3-D portion 105. One or multiple pop-up decorative pieces 303 are attached, either between block layers or by adhesive means. Then the completed artistic composition may be hung on a wall by using the frame hanging feature 151.

The fourth embodiment, which presents a third aspect of the frame and two specialized blocks (a separable hanger 140 and a platform-topped block 145 with an associated ornamental platform element 149), is shown in FIGS. 30-53. As in the other embodiments, the construction elements include a template 110, base plate 120, graphic segment(s) 130, and frame 150, which are assembled to form a foundational play surface structure onto which the removable and replaceable building elements 200 will be attached. In this embodiment, the building elements 200 include standard modular building blocks 101 and platform-topped blocks 145 that receive the ornamental platform elements 149. The pop-up decorative pieces 303 of the third embodiment (not shown for clarity) may also optionally be used with the fourth embodiment.

Figure 30:
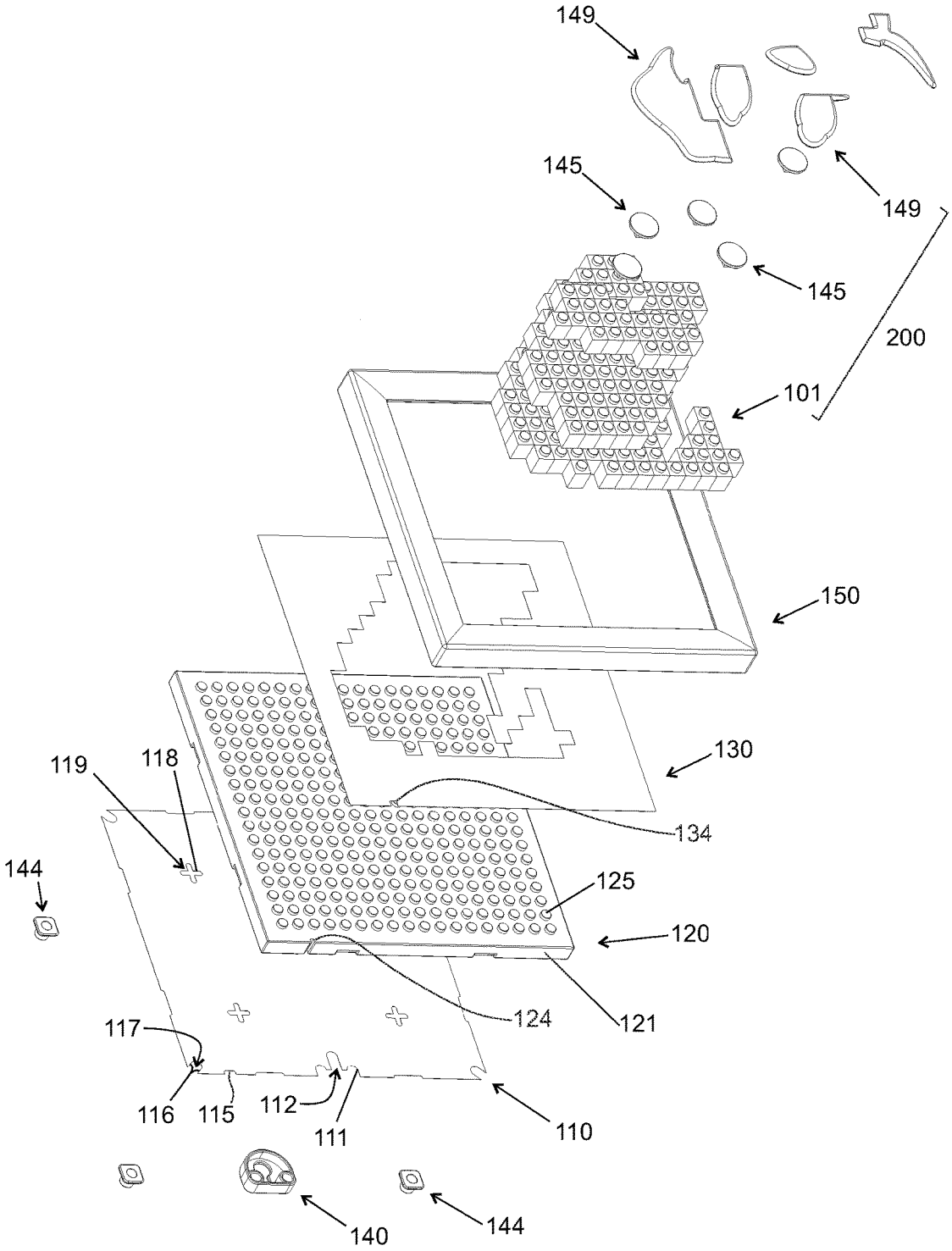
FIG. 30 is a diagrammatic top exploded view of a fourth embodiment of the present invention, which includes a hanger, template sheet, base plate, graphic segment, frame, standard modular building blocks, and platform-topped blocks with associated ornamental platform elements.
Figure 31:
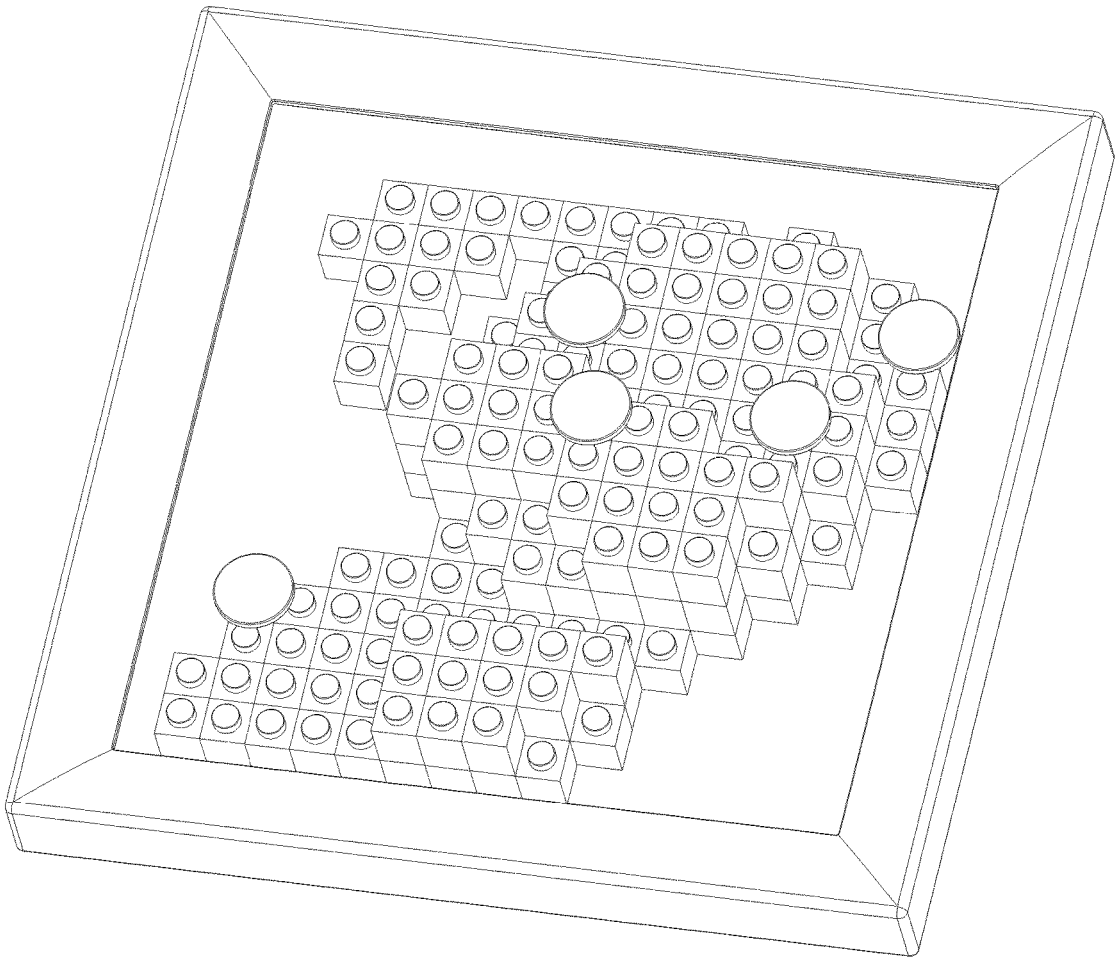
FIG. 31 is a top perspective view of the fourth embodiment of the present invention showing the frame and platform-topped blocks for receiving the ornamental platform elements.
Figure 32:
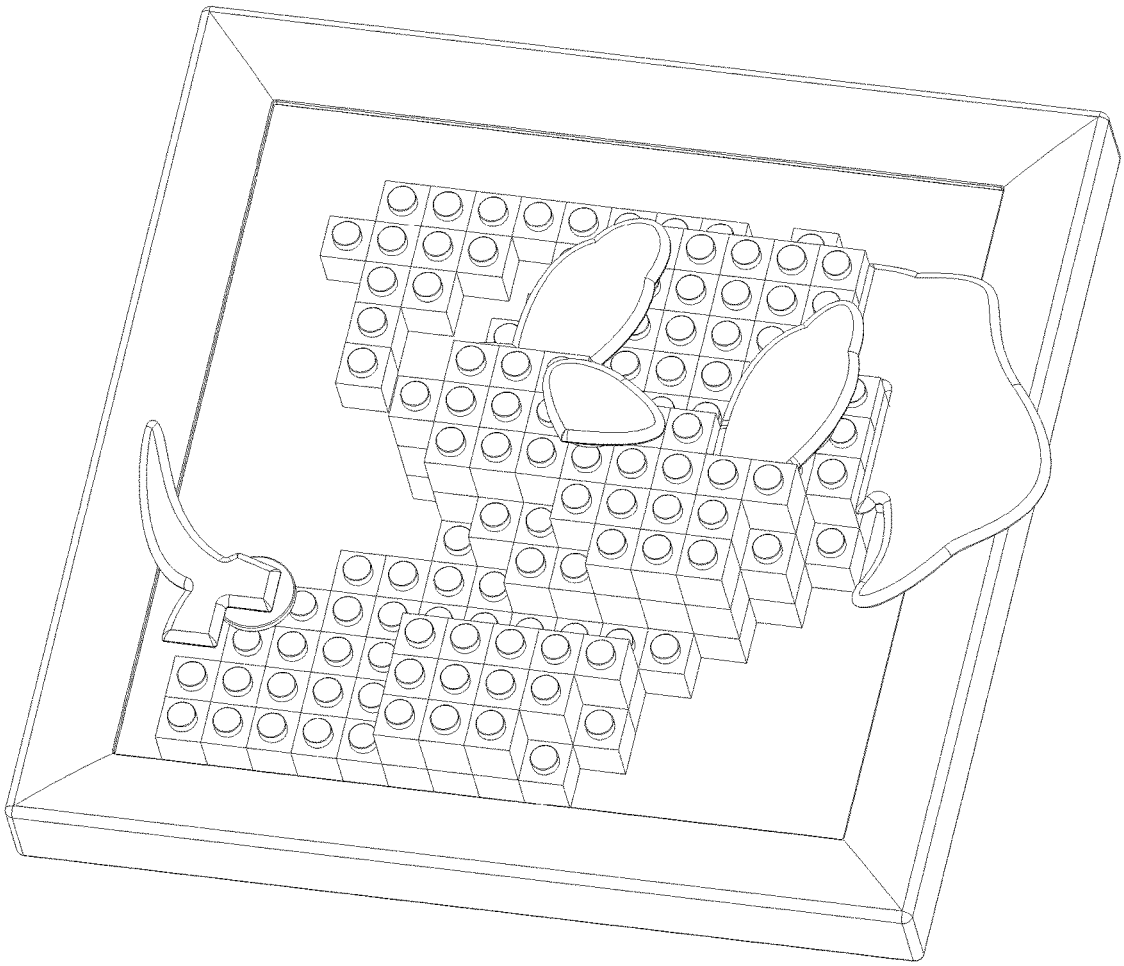
FIG. 32 is a top perspective view of the fourth embodiment of the present invention showing the frame and platform-topped blocks with attached ornamental platform elements.
Figure 33:
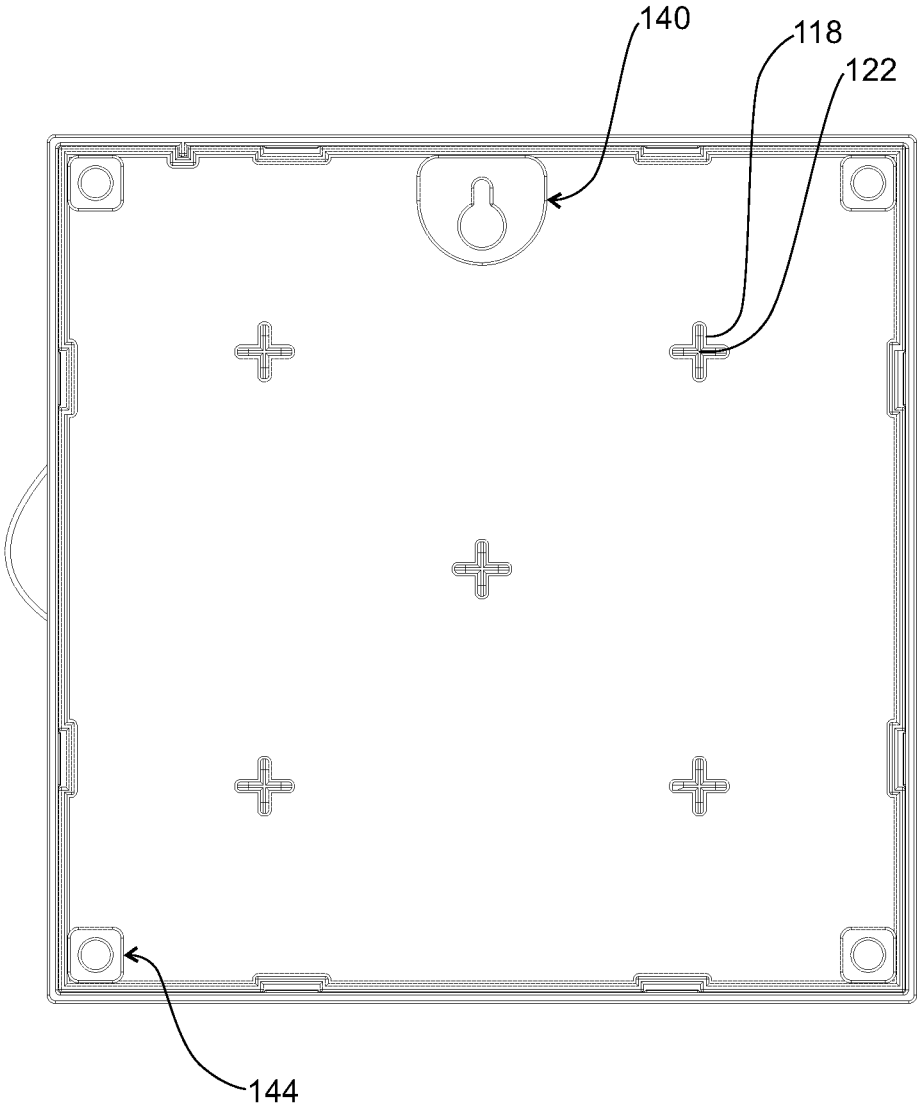
FIG. 33 is a back view of the fourth embodiment of the present invention showing the frame and hanger.
Figure 43:
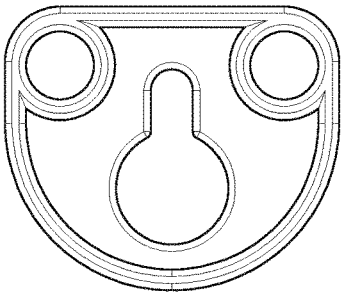
FIGS. 43-49 are top, top perspective, first side, second side, third side, bottom perspective, and top perspective views of the removably attachable hanger, respectively.
Figure 44:
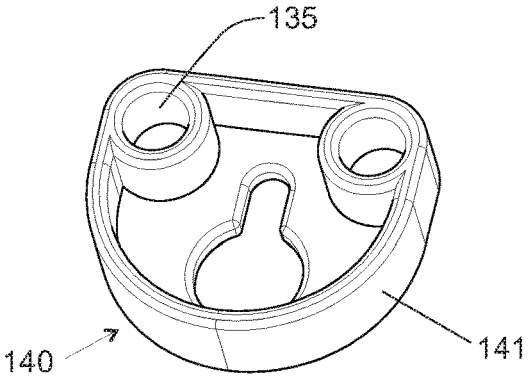
Figure 45:
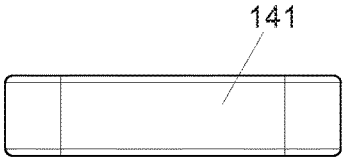
Figure 46:
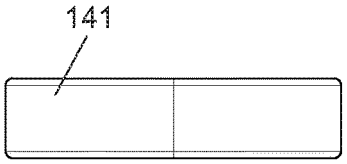
Figure 47:
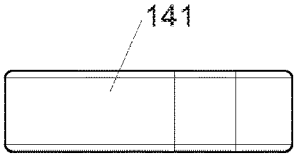
Figure 48:
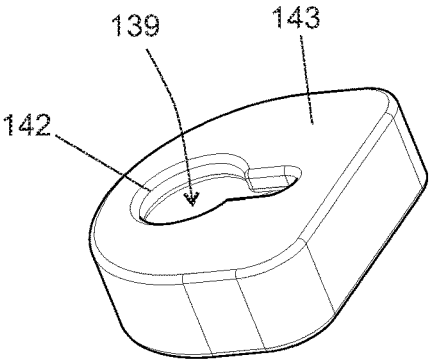
Figure 49:
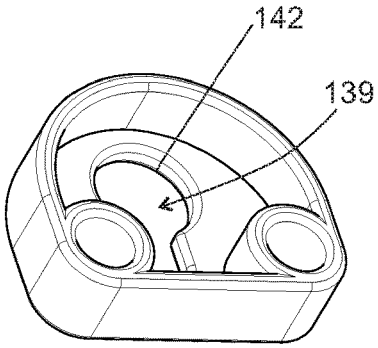
Figure 50:
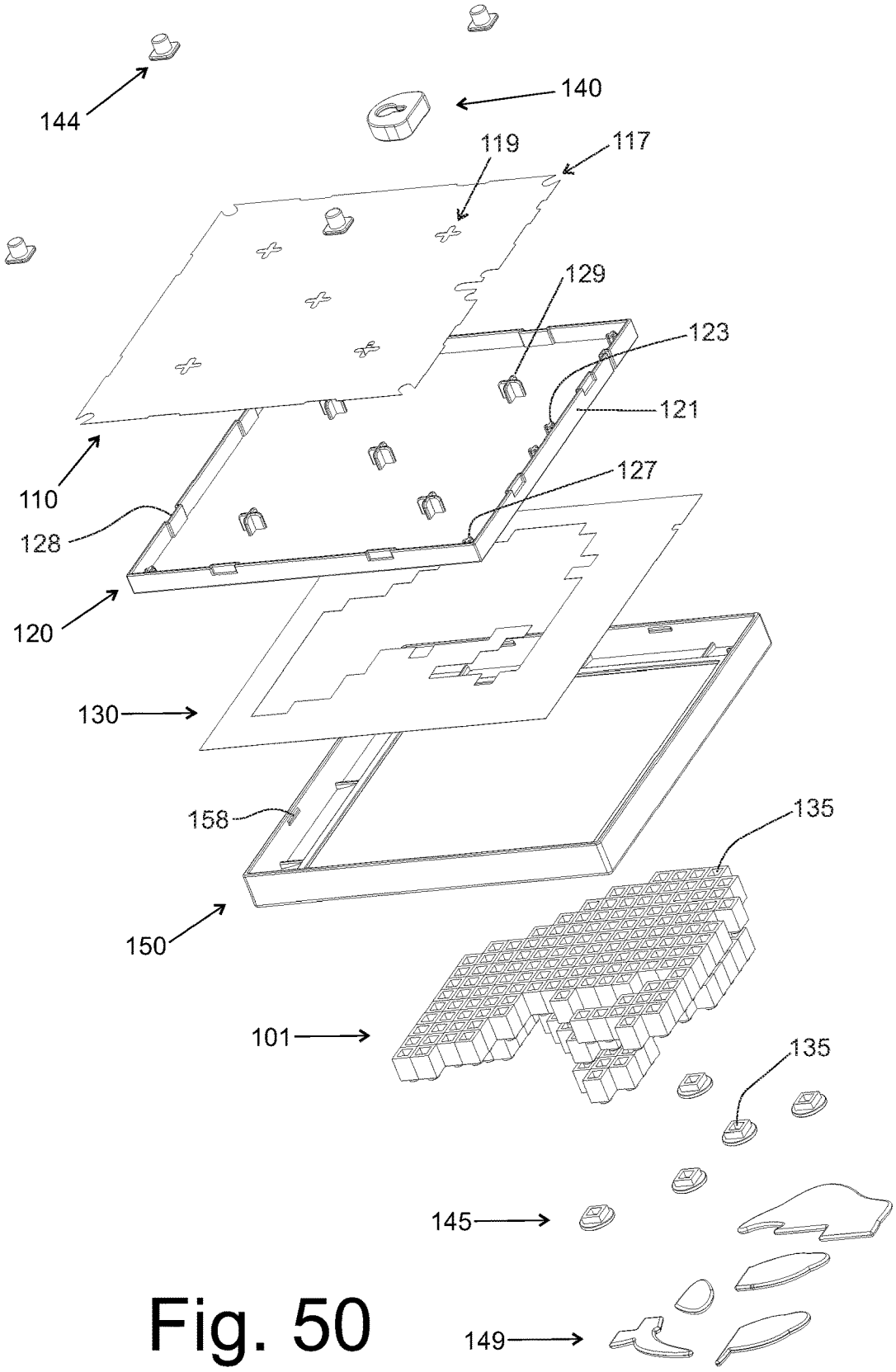
FIG. 50 is a bottom exploded view of the fourth embodiment of the present invention, which includes a removably attachable hanger, template, base plate, graphic segment, frame, standard blocks, platform-topped blocks, and ornamental platform elements.
Figure 51:
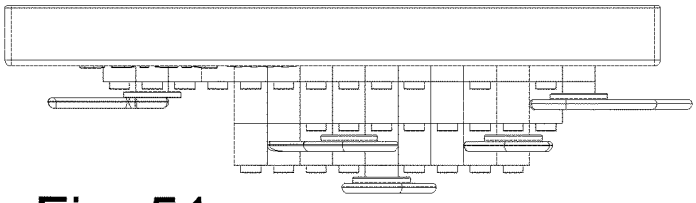
FIGS. 51-55 show a first side view, second side view, third side view, fourth side view, and top view, respectively, of the completed fourth embodiment of the present invention.
Figure 52:
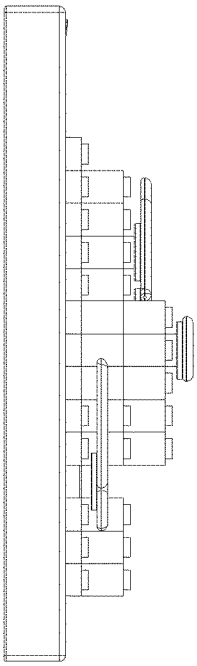
Figure 55:
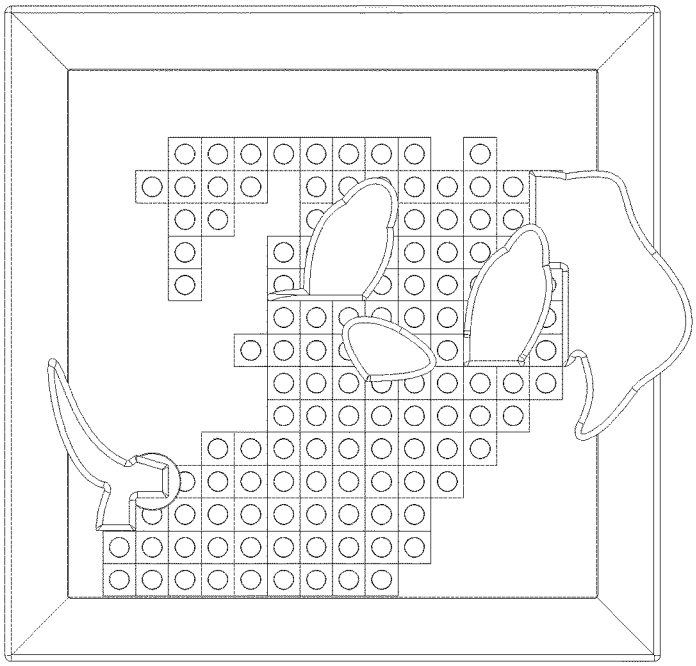
Figure 54:
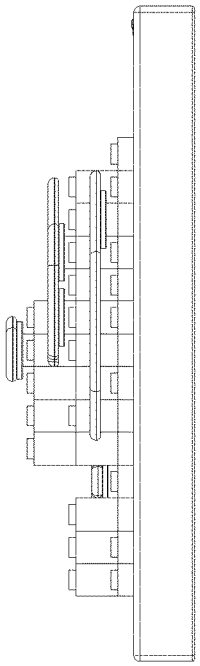
Figure 53:
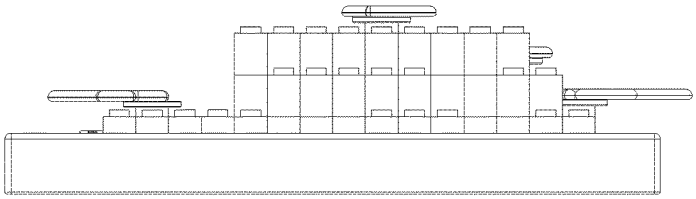

FIG. 30 shows the exploded fourth embodiment from the front, while FIG. 50 shows it from the back. As can be seen in these images, the template sheet 110 may be configured with edge alignment holes 117 defined by edge alignment hole edges 116 and/or may be configured with internal alignment holes 119 defined by internal alignment hole edges 118. These holes 117 and/or holes 119 serve to position the template sheet 110 correctly as it is situated against the back surface of the base plate 120. Preferably the base plate 120 comprises exterior flanges 121 that have a depth greater than the depth of the template sheet 110, so the template sheet 110 fits within the back portion of the base plate 120.

The rear surface of the base plate 120 is configured with edge protuberances 127 (FIG. 50) and/or internal protuberances 129 that are sized and shaped to receive the edge alignment holes 117 and/or the internal alignment holes 119, respectively. These protuberances 127, 129, which are preferably integrally formed when the base plate 120 is molded, preferably have a length that is equal to or less than the depth of the exterior flanges 121, so the assembled construction craft lies flat. The protuberances 127, 129 may have cross sections that are circular, square, hexagonal, cross-shaped, or the like. The edge protuberances 127 and internal protuberances 129 may have any of a number of shapes, such as a column having a circular cross section, square cross section, cross-shaped cross section, or a cross section of other regular or irregular shapes.

After installing the template sheet 110 by slipping the internal holes 119 over the protuberances 129, preferably a securing member 144 is attached to the end of each of the protuberances 129. The securing member 144 is a cap-like element with an internal receiving area configured to fit the external surface of the protuberance 129. The securing member 144 may be formed of rigid plastic, flexible plastic, rubber, rubber-like material, or the like.

Additionally, the base plate 120 is configured with a hanger receiver 123 that receives a separable hanger 140. The hanger receiver 123 comprises a base plate coupling member, and the separable hanger 140 comprises a complementary hanger coupling member. In the figures, the hanger receiver 123 is illustrated as two male coupling members formed of outwardly-protruding pegs, and the separable hanger 140 is illustrated with two female coupling structures 135 (FIG. 44) that attach to the male coupling members. However, the base plate coupling member and hanger coupling member can any complementary coupling members. For example, the hanger 140 may be configured with outwardly-projecting studs to fit into the female coupling structures of standard modular building block base plate, thereby allowing the hanger 140 to be used independently with conventional building block base plates if they have a rear surface formed to receive projecting male studs.

To accommodate the coupling of the separable hanger 140 to the hanger receiver 123 of the base plate, the template sheet 110 may be configured with a hanger provision cutout 112 defined by hanger provision edges 111 (FIG. 30).

In addition to the hanger coupling members shown as female coupling structures 135, the separable hanger 140, best seen in FIGS. 43-49, may have a backing 143 (FIG. 48), a flange 141, and a keyhole 139. The backing 143 forms a back plate with the flange 141 extending generally around the perimeter of the backing back plate 139. The flange 143 preferably has a depth less than the depth of the base plate flange 121. The keyhole 139, defined by keyhole edges 142, is configured in a conventional manner with a larger lower circle with an upper slot to accommodate a nail or screw head or the like.

The fourth embodiment also provides a specialized type of building block, which is the platform-topped block 145 that is best seen in FIGS. 34-37. The platform block 145 has a lower part 143 configured with a standard coupling means, female coupling structure 135, which is sized and configured to frictionally engage with standard base plate male studs 125 or standard block studs 302. At the opposite end of the platform block 145 is a platform 147, which comprises an integrally formed thin, flat section. The platform 147 is illustrated as a flat disk, but may equally well take other shapes. For example, the upper surface 146 (FIG. 34) may be circular (as shown), square, rectangular, hexagonal, pentagonal, or may take the form of other regular or irregular geometric shapes. The platform 147 extends outwardly past the exterior portions of the block lower part 143. Preferably the width of the platform 147 is at least 50% greater than the width of the lower portion 143 and may have a width of many times the width of the lower portion 143. Preferably the height of the platform 147 is less than one half of the height of the lower part 143 of the block 145. The platform block 145 is formed of standard plastic block material.

The top surface 146 of a platform block 145 is designed and configured to receive an ornamental platform element 149. The ornamental platform element 149 to be received by the top surface 146 has an upper surface 156 that is decorative. Preferably the ornamental platform element 149 is rigid or semi-rigid, so it will hold its shape when attached to the platform block 145. Preferably the upper surface 156 displays a full-color graphic. In one aspect the ornamental platform element 149 may be a vinyl decal or vinyl sticker displaying a color graphical image and having a removable backing protecting an adhesive layer, which is adhered to the surface 146. In another aspect, the ornamental platform element 149 may be a laminated cardboard, paperboard, or plastic sheet that is adhered to the surface 146 by adhesive. In one aspect a glue dot may be placed on the surface 146 to adhere the ornamental platform element 149.

The ornamental platform elements 149 provided in a single construction craft kit may be similar in shape, or as seen in FIGS. 38-42, 55 may be varied in shape. For example, in FIG. 55, the ornamental platform elements 149 complete the designed pattern by being shaped in the form of nose, ears, eyes, and tail. As seen in the side views of FIGS. 51-54, the platform blocks 145 may be positioned at different levels, such as at the top of the first level of blocks, at the top of a two-high block stack, at the top of a three-high block stack, etc.

To use the fourth embodiment of the invention, the user first assembles construction elements to create a foundational play surface structure onto which the removable and replaceable building elements 200 will be attached to create the artistic composition. To create the foundational structure, the user places the template sheet 110 under the base plate 120 and slips the internal holes 119 over the protuberances 129 and slips the edge protuberances 127 over the edge holes 117 with alignment notches 115 aligned with alignment element 124. A securing member 144 is attached to the distal end of each of the protuberances 129. The graphic element 130 is then situated into the back of the frame 150 with alignment element 134 aligned with a corresponding alignment element inside the frame 150. The transparent plastic base plate 120 and attached template 110 is then snapped into the back of the frame 150 by engaging complementary coupling members 128, 158 (FIG. 50). (Optionally, the graphic segment 130 may be situated above the base plate 120.)

The created foundational play surface structure is then complete. The user then attaches modular building blocks 101 (as designated by the guidance indicia 113), platform blocks 145 (as designated by guidance indicia 113 or by accompanying instructions), and any pop-up decorative pieces 303 of the particular pre-determined design, as described above. The associated ornamental platform elements 149 are then attached to the platform 147 via removal of a sheet covering an adhesive back and attachment of the adhesive back to the top surface 146, via the attachment of a glue dot to the top surface 146 and adherence of an associated ornamental platform element 149 to the glue dot, or via other attachment means.

The invention illustratively disclosed herein suitably may be practiced in the absence of any element which is not specifically disclosed herein. The mirror image of each design is also disclosed.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A construction craft utilizing modular building blocks each of which has a male stud and a complementary, opposing female coupling structure, comprising:

a transparent base plate comprising a flat base, forward-facing multiple base studs, and rearward-facing multiple protuberances; wherein said flat base has a front surface and a back surface; wherein said multiple base studs are integrally formed with said flat base and extend forwardly from said front surface; wherein said rearward-facing multiple protuberances are integrally formed with said flat base and extend rearwardly from said back surface; wherein at least a portion of said rearward-facing multiple protuberances are disposed within an interior of said flat base; wherein each of said base studs are configured to fit into said female coupling structure of one of said modular building blocks; and wherein said base plate includes outer perimeter edges;

a template sheet sized and configured to be received below said base plate and having at least one area of designation configured with guidance indicia comprising multiple guidance indicium; wherein, when said template sheet is positioned below said base plate, each guidance indicium is positioned under a particular one of said base studs and each guidance indicium provides information to indicate a height of at least one of said modular building blocks that is designated to be attached to said particular one of said base studs; wherein said template sheet is configured with internal alignment holes defined by internal alignment hole edges, and when said template sheet is positioned below said base pate, each of said internal alignment holes receives one of said rearward-facing multiple protuberances disposed within the interior of said flat base; and wherein, upon placement of multiple designated ones of said modular building blocks on ones of said base studs, a dimensional 3-D block construction structure is created;

at least one graphic segment having a decorative top surface and configured to fit adjacent to at least a portion of said dimensional 3-D block construction structure on said base plate; and a platform block comprising an upper platform having a flat top surface and a platform block lower part having exterior side surfaces; wherein said platform block lower part comprises at least one lower female coupling structure that is complementary to said base studs of said base plate; and wherein said upper platform extends outwardly past said exterior side surfaces of said platform block lower part.

2. The construction craft, as recited in claim 1, wherein said guidance indicium associated with said particular one of said base studs comprises a number on a colored field, indicating both said height and a color of said of at least one of said modular building blocks that is designated to be attached to said particular one of said base studs.

3. The construction craft, as recited in claim 1, further comprising a pop-up decorative piece having a decorative top surface; wherein said pop-up decorative piece is attachable to said construction craft; and wherein said pop-up decorative piece, upon attachment to said construction craft, extends past said outer perimeter edges of said base plate.

4. The construction craft, as recited in claim 1, further comprising a block-attachable pop-up decorative piece having a decorative top surface and having an opposing lower female coupling structure configured to receive one of said male studs of said modular building blocks.

5. The construction craft, as recited in claim 1, further comprising an adhesively-attachable pop-up decorative piece having a decorative top surface and having an opposing flat lower surface.

6. The construction craft, as recited in claim 1, further comprising a thin pop-up decorative piece having a decorative top surface and having multiple attachment holes defined by attachment hole edges extending vertically through said thin pop-up decorative piece; wherein said attachment holes have a larger diameter than the diameter of said male stud of said modular building block; and wherein the spacing between said attachment holes corresponds to the spacing between said base studs of said base plate.

7. The construction craft, as recited in claim 1, further comprising a multi-piece frame comprising an upper frame and a lower frame that are releasably connectable; wherein, when said construction craft is assembled, said base plate, said at least one graphic segment, and said template sheet are accommodated within said multi-piece frame.

8. The construction craft, as recited in claim 1, upper platform comprises outer edges; and wherein said outer edges extend outwardly past all of said exterior side surfaces of said platform block lower part.

9. The construction craft, as recited in claim 1, further comprising:

an ornamental platform element having a flat bottom surface, a decorative top surface, adhesive applied to said bottom surface, and a removable sheet covering said adhesive; wherein said adhesive attaches said ornamental platform element to said flat top surface of said platform block after removal of said removable sheet.

10. The construction craft, as recited in claim 1, further comprising a separable hanger having a back configured with a keyhole and having at least two hanger female coupling structures configured to receive one of said rearward-facing multiple protuberances.

11. The construction craft, as recited in claim 1, wherein said at least one graphic segment comprises multiple graphic segments, each of which extend from a portion of said dimensional 3-D block construction structure to said outer perimeter edges.

12. The construction craft, as recited in claim 1, wherein:

a portion of said rearward-facing multiple protuberances are disposed along said outer perimeter edges of said flat base; and said template sheet is configured with edge alignment holes defined by edge alignment hole edges, and when said template sheet is positioned below said base pate, each of said edge alignment holes receives one of said rearward-facing multiple protuberances disposed along said outer perimeter edges of said flat base.

13. A construction craft utilizing modular building blocks each of which has a male stud and a complementary, opposing female coupling structure, comprising:

a transparent base plate comprising a flat base, forward-facing multiple base studs, and rearward-facing multiple protuberances; wherein said flat base has a front surface and a back surface; wherein said multiple base studs are integrally formed with said flat base and extend forwardly from said front surface; wherein said rearward-facing multiple protuberances are integrally formed with said flat base and extend rearwardly from said back surface; wherein at least a portion of said rearward-facing multiple protuberances are disposed within an interior of said flat base; wherein each of said base studs are configured to fit into said female coupling structure of one of said modular building blocks; wherein each of said base studs has a diameter corresponding to the diameter of said male stud of said modular building block; and wherein said base plate includes outer perimeter edges;

a template sheet sized and configured to be received below said base plate, having at least one area of designation configured with guidance indicia comprising multiple guidance indicium; wherein said template sheet is configured with internal alignment holes defined by internal alignment hole edges, and when said template sheet is positioned below said base pate, each of said internal alignment holes receives one of said rearward-facing multiple protuberances disposed within the interior of said flat base; wherein, when said template sheet is positioned below said base plate, each guidance indicium is positioned under a particular one of said base studs and each guidance indicium provides information to indicate both a height and a color of at least one of said modular building blocks that is designated to be attached to said particular one of said base studs; wherein, upon placement of multiple designated ones of said modular building blocks on correlating ones of said base studs, a dimensional 3-D block construction structure is created;

at least one graphic segment having a decorative top surface and configured to cover an area of said base plate outside of said at least one area of designation; and a platform block comprising an upper platform having a flat top surface and a platform block lower part having exterior side surfaces; wherein said platform block lower part comprises at least one lower female coupling structure that is complementary to said base studs of said base plate; and wherein said upper platform extends outwardly past said exterior side surfaces of said platform block lower part.

14. The construction craft, as recited in claim 13, further comprising a pop-up decorative piece having a decorative top surface; wherein said pop-up decorative piece is attachable to said construction craft; and wherein said pop-up decorative piece, upon attachment to said construction craft, extends past said outer perimeter edges of said base plate.

15. The construction craft, as recited in claim 13, further comprising a thin pop-up decorative piece having a decorative top surface and having multiple attachment holes defined by attachment hole edges extending vertically through said thin pop-up decorative piece; wherein said attachment holes have a larger diameter than the diameter of said male stud of said modular building block; and wherein the spacing between said attachment holes corresponds to the spacing between said base studs of said base plate.

16. The construction craft, as recited in claim 13, wherein said graphic segment is configured to fit adjacent to at least a portion of said dimensional 3-D block construction structure on said base plate and to extend to said outer perimeter edges of said baseplate.

17. The construction craft, as recited in claim 13, further comprising:

an ornamental platform element having a flat bottom surface, a decorative top surface, adhesive applied to said bottom surface, and a removable sheet covering said adhesive; wherein said adhesive attaches said ornamental platform element to said flat top surface of said platform block after removal of said removable sheet.

18. The construction craft, as recited in claim 13, further comprising a separable hanger having a back configured with a keyhole and having at least two hanger female coupling structures configured to receive one of said rearward-facing multiple protuberances.

19. The construction craft, as recited in claim 13, wherein:

a portion of said rearward-facing multiple protuberances are disposed along said outer perimeter edges of said flat base; and said template sheet is configured with edge alignment holes defined by edge alignment hole edges, and when said template sheet is positioned below said base pate, each of said edge alignment holes receives one of said rearward-facing multiple protuberances disposed along said outer perimeter edges of said flat base.

20. The construction craft, as recited in claim 13, further comprising a separable hanger having a back configured with a keyhole and having at least two hanger female coupling structures configured to receive one of said rearward-facing multiple protuberances.

* * * * *